US009310722B2

(12) United States Patent
Tanaka et al.

(10) Patent No.: US 9,310,722 B2
(45) Date of Patent: Apr. 12, 2016

(54) IMAGE FORMING APPARATUS AND IMAGE FORMING METHOD

(75) Inventors: Shinya Tanaka, Kanagawa (JP); Naomi Sugimoto, Kanagawa (JP); Haruo Iimura, Kanagawa (JP); Shinji Aoki, Kanagawa (JP); Yasuhiko Ogino, Kanagawa (JP); Kazuchika Saeki, Saitama (JP); Keigo Nakamura, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/005,770

(22) PCT Filed: Mar. 16, 2012

(86) PCT No.: PCT/JP2012/057656

§ 371 (c)(1),
(2), (4) Date: Sep. 17, 2013

(87) PCT Pub. No.: WO2012/128373

PCT Pub. Date: Sep. 27, 2012

(65) Prior Publication Data

US 2014/0010562 A1 Jan. 9, 2014

(30) Foreign Application Priority Data

Mar. 18, 2011 (JP) ..... 2011-061680
Nov. 14, 2011 (JP) ..... 2011-249014
Feb. 10, 2012 (JP) ..... 2012-027364

(51) Int. Cl.
*G03G 15/16* (2006.01)
*G03G 15/01* (2006.01)

(52) U.S. Cl.
CPC ..... *G03G 15/1675* (2013.01); *G03G 15/0131* (2013.01); *G03G 15/0189* (2013.01)

(58) Field of Classification Search
CPC ..... G03G 15/1675; G03G 15/0131; G03G 15/1665
See application file for complete search history.

(56) References Cited

U.S. PATENT DOCUMENTS 5,260,754 A 11/1993 Yano et al.
5,386,274 A 1/1995 Sanpe et al.

(Continued)

FOREIGN PATENT DOCUMENTS

JP 02-300774 12/1990
JP 07-036873 2/1995

(Continued)

OTHER PUBLICATIONS

International Search Report Issued Apr. 24, 2012 in PCT/JP12/057656 Filed Mar. 16, 2012.

(Continued)

*Primary Examiner* — David Gray
*Assistant Examiner* — Carla Therrien
(74) *Attorney, Agent, or Firm* — Oblon, McClelland, Maier & Neustadt, L.L.P

(57) ABSTRACT

[Problem to be solved] To provide an image forming apparatus for suppressing formations of white spots and achieving high quality images, while obtaining sufficient image densities in both of the recessed parts and the projected parts of a recording medium surface.

[Solution] An image forming apparatus includes a transfer member 36 that abuts against a surface of an image carrier carrying a toner image and forms a transfer nip, and a power supply 39 that outputs a voltage (transfer bias) for causing the toner image on the image carrier to be transferred onto a recording medium P nipped in the transfer nip. The voltage is switched alternatingly between a transfer direction voltage for causing the toner image to be transferred from the image carrier onto the recording medium and a voltage having an opposite polarity of the transfer direction voltage when the toner image on the image carrier is to be transferred onto the recording medium. A time-averaged value ($V_{ave}$) of the voltage is set to a transfer direction polarity that causes the toner image to be transferred from the image carrier onto the recording medium, and is set more in the transfer direction than a median voltage ($V_{off}$) between a maximum and a minimum of the voltage.

29 Claims, 30 Drawing Sheets

(56) References Cited

U.S. PATENT DOCUMENTS 5,526,100 A 6/1996 Misago et al.
5,585,896 A 12/1996 Yamazaki et al.
5,592,267 A 1/1997 Misago et al.
5,595,852 A 1/1997 Shimoda et al.
5,678,129 A 10/1997 Yasuda et al.
5,749,022 A 5/1998 Kikui et al.
6,284,424 B1 9/2001 Iimura et al.
6,757,511 B2 6/2004 Sugimoto et al.
6,766,125 B1 7/2004 Izumi
7,561,835 B2 7/2009 Tanaka et al.
7,662,530 B2 2/2010 Iimura
7,715,760 B2 5/2010 Sugimoto et al.
7,720,418 B2 5/2010 Tanaka et al.
7,941,087 B2 5/2011 Tanaka et al.
7,979,017 B2 7/2011 Tanaka et al.
8,041,276 B2 10/2011 Ogino
8,041,281 B2 10/2011 Sugimoto et al.
8,045,875 B2 10/2011 Aoki et al.
8,081,916 B2 12/2011 Tanaka et al.
8,165,481 B2 4/2012 Iimura
8,385,807 B2 2/2013 Tanaka et al.
8,422,900 B2 4/2013 Aoki et al.
8,437,676 B2 5/2013 Tanaka et al.
8,452,222 B2 5/2013 Tanaka et al.
8,626,011 B2 * 1/2014 Yamada ..... 399/44
8,682,231 B2 * 3/2014 Sengoku et al. ..... 399/296
8,712,267 B2 * 4/2014 Sugimoto et al. ..... 399/66
8,750,736 B2 * 6/2014 Nakamura et al. ..... 399/66
8,761,620 B2 * 6/2014 Takeuchi ..... 399/45
8,781,348 B2 * 7/2014 Ogino et al. ..... 399/45
8,787,806 B2 * 7/2014 Nakamura et al. ..... 399/315
8,891,996 B2 * 11/2014 Fujita et al. ..... 399/88
8,909,079 B2 * 12/2014 Aoki et al. ..... 399/66
8,923,716 B2 * 12/2014 Nakamura et al. ..... 399/66
8,929,760 B2 * 1/2015 Tanaka et al. ..... 399/66
8,934,822 B2 * 1/2015 Mimbu et al. ..... 399/314
2002/0009312 A1 1/2002 Sugimoto et al.
2002/0114648 A1 8/2002 Sugimoto et al.
2002/0181983 A1 12/2002 Shakuto et al.
2003/0039494 A1 2/2003 Shakuto et al.
2004/0131373 A1 7/2004 Saito et al.
2006/0045554 A1 3/2006 Saeki
2006/0215202 A1 9/2006 Nakata et al.
2006/0239722 A1 10/2006 Tanaka et al.
2006/0245794 A1 11/2006 Honda et al.
2006/0292470 A1 12/2006 Iimura
2007/0025769 A1 2/2007 Someya et al.
2007/0178398 A1 8/2007 Ogino et al.
2007/0212139 A1 9/2007 Sugiura et al.
2007/0224528 A1 9/2007 Yamashita et al.
2007/0229898 A1 10/2007 Tomaru
2007/0231010 A1 10/2007 Ohta et al.
2007/0279674 A1 12/2007 Oomura
2008/0040803 A1 2/2008 Ehara
2008/0095553 A1 4/2008 Tanaka et al.
2008/0118286 A1 5/2008 Yamashita et al.
2008/0138132 A1 6/2008 Yamashita et al.
2008/0170878 A1 7/2008 Yamashita et al.
2008/0187857 A1 8/2008 Ogino et al.
2008/0193178 A1 8/2008 Sugimoto et al.
2008/0193179 A1 8/2008 Sugimoto et al.
2008/0253815 A1 10/2008 Yano et al.
2008/0310897 A1 12/2008 Naruse et al.
2009/0035038 A1 2/2009 Sugimoto et al.
2009/0092428 A1 4/2009 Yano et al.
2009/0116872 A1 5/2009 Sugimoto et al.
2009/0123168 A1 5/2009 Aoki et al.
2009/0142087 A1 6/2009 Iimura
2009/0196665 A1 8/2009 Tanaka et al.
2009/0279930 A1 11/2009 Kabata et al.
2009/0285613 A1 11/2009 Nakai et al.
2009/0290919 A1 11/2009 Tanaka et al.
2009/0304423 A1 12/2009 Ozaki et al.
2009/0311004 A1 12/2009 Naruse et al.
2009/0311014 A1 12/2009 Tanaka et al.
2010/0003052 A1 1/2010 Nakamatsu et al.
2010/0008706 A1 1/2010 Sugiura et al.
2010/0034549 A1 2/2010 Nakamatsu et al.
2010/0034560 A1 2/2010 Tanaka et al.
2010/0054829 A1 3/2010 Iio et al.
2010/0073697 A1 3/2010 Someya et al.
2010/0098446 A1 4/2010 Ishikawa et al.
2010/0183972 A1 7/2010 Hasegawa et al.
2010/0209143 A1 8/2010 Nakai et al.
2010/0226697 A1 9/2010 Ogino
2010/0232820 A1 9/2010 Usami et al.
2010/0239302 A1 9/2010 Naruse et al.
2010/0239309 A1 9/2010 Tanaka et al.
2010/0284705 A1 11/2010 Aoki et al.
2010/0303518 A1 12/2010 Aimoto et al.
2010/0310291 A1 12/2010 Tanaka et al.
2010/0329707 A1 12/2010 Yamada
2011/0008088 A1 1/2011 Nakai et al.
2011/0038656 A1 2/2011 Hasegawa et al.
2011/0052286 A1 3/2011 Urayama et al.
2011/0058831 A1 3/2011 Usami et al.
2011/0085834 A1 4/2011 Naruse et al.
2011/0103822 A1 5/2011 Sugiura et al.
2011/0158677 A1 6/2011 Kikuchi et al.
2011/0200348 A1 8/2011 Aoki
2011/0229168 A1 9/2011 Shiraishi et al.
2011/0229187 A1 9/2011 Hozumi et al.
2011/0229234 A1 9/2011 Hozumi et al.
2011/0255892 A1 10/2011 Aoki
2011/0279864 A1 11/2011 Tomaru
2012/0045231 A1 2/2012 Ogino et al.
2012/0045237 A1 2/2012 Aoki et al.
2012/0045259 A1 2/2012 Nakamura et al.
2012/0308250 A1 * 12/2012 Shimizu et al. ..... 399/66
2012/0315058 A1 * 12/2012 Shimizu et al. ..... 399/66
2012/0328314 A1 * 12/2012 Sugimoto et al. ..... 399/66
2013/0136468 A1 * 5/2013 Shimizu et al. ..... 399/44
2013/0136477 A1 * 5/2013 Ogiyama et al. ..... 399/66
2013/0142531 A1 * 6/2013 Sugimoto et al. ..... 399/66
2013/0148993 A1 * 6/2013 Aoki et al. ..... 399/66
2013/0164011 A1 * 6/2013 Nakamura et al. ..... 399/66
2013/0177329 A1 * 7/2013 Tanaka et al. ..... 399/66
2013/0195483 A1 * 8/2013 Shimizu et al. ..... 399/45
2013/0236201 A1 * 9/2013 Mizutani et al. ..... 399/53
2013/0308968 A1 * 11/2013 Tanaka et al. ..... 399/44
2014/0029988 A1 * 1/2014 Shimizu et al. ..... 399/314
2014/0079418 A1 * 3/2014 Tanaka et al. ..... 399/44
2014/0248064 A1 * 9/2014 Tanaka et al. ..... 399/66
2014/0270830 A1 * 9/2014 Nakamura et al. ..... 399/66
2014/0314435 A1 * 10/2014 Kato et al. ..... 399/66
2014/0328604 A1 * 11/2014 Tanaka et al. ..... 399/66
2015/0212453 A1 * 7/2015 Tanaka ..... G03G 15/1675 399/66

FOREIGN PATENT DOCUMENTS

JP 9-106192 A 4/1997
JP 09-146381 6/1997
JP 9-212013 A 8/1997
JP 09-258580 10/1997
JP 2000-131961 5/2000
JP 2001-256076 9/2001
JP 2002-149371 5/2002
JP 2003-57924 A 2/2003
JP 3514193 3/2004
JP 2004-213376 7/2004
JP 2004-287566 10/2004
JP 3576829 10/2004
JP 2004-326510 11/2004
JP 2005-173720 6/2005
JP 2005-258287 9/2005
JP 2006-021487 1/2006
JP 2006-071954 3/2006
JP 2006-236220 9/2006
JP 2006-267486 10/2006
JP 2007-193649 8/2007
JP 2007-268783 10/2007
JP 2007-304734 11/2007
JP 2007-313780 12/2007

(56) References Cited

FOREIGN PATENT DOCUMENTS

| | | |
|---|---|---|
| JP | 2007-323191 | 12/2007 |
| JP | 2007-328196 | 12/2007 |
| JP | 2007-334539 | 12/2007 |
| JP | 2008-020946 | 1/2008 |
| JP | 2008-046826 | 2/2008 |
| JP | 2008-065687 | 3/2008 |
| JP | 2008-117255 | 5/2008 |
| JP | 2008-154106 | 7/2008 |
| JP | 4110147 | 7/2008 |
| JP | 2008-210043 | 9/2008 |
| JP | 2008-287396 | 11/2008 |
| JP | 2009-110179 | 5/2009 |
| JP | 4344447 | 10/2009 |
| JP | 2009-259014 | 11/2009 |
| JP | 2010-005820 | 1/2010 |
| JP | 4506597 | 7/2010 |
| JP | 2010-281907 | 12/2010 |
| JP | 2011-013241 | 1/2011 |
| JP | 2012-042827 | 3/2012 |
| JP | 2012-042832 | 3/2012 |
| JP | 2012-042835 | 3/2012 |
| JP | 2012-051296 | 3/2012 |
| JP | 2012-063746 | 3/2012 |

OTHER PUBLICATIONS

Office Action issued Sep. 11, 2014, in Korean Patent Application No. 10-2013-7024092 with English translation.

Extended European Search Report issued Sep. 26, 2014, in European Patent Application No. 12760593.9.

Office Action issued on May 11, 2015, for Chinese Application No. 201280013406.2 (with English translation).

* cited by examiner (FIRST EXAMPLE)

(SECOND EXAMPLE)

(THIRD EXAMPLE)

(FOURTH EXAMPLE)

(FIFTH EXAMPLE)

(SIXTH EXAMPLE)

(SEVENTH EXAMPLE)

(EIGHTH EXAMPLE AND NINTH EXAMPLE)

(TENTH EXAMPLE)

FIG.27

EFFECT OF FIRST COMPARATIVE EXAMPLE

SINE WAVE
RETURNING TIME 50%

| $V_{ave}$ \ $V_{pp}$ | 8 | 10 | 12 | 14 | 16 | 18 |
|---|---|---|---|---|---|---|
| -7.6 | | | | | | |
| -7.4 | | | | | | |
| -7.2 | | | | | | |
| -7 | | | | | | |
| -6.8 | | | | | | |
| -6.6 | | | | | | |
| -6.4 | | | | | | |
| -6.2 | | | | | | |
| -6 | | | | | | |
| -5.8 | | | | | | |
| -5.6 | | | | | | |
| -5.4 | × | × | × | × | | |
| -5.2 | × | × | × | × | | |
| [illegible] | × | △ | × | × | | |
| [illegible] | × | △ | △ | × | | |
| -4.6 | △ | ○ | △ | × | | |
| -4.4 | × | △ | △ | × | | |
| -4.2 | × | × | × | × | | |
| -4 | | | | | | |

LIGHT ON RECESSED PARTS

WHITE SPOTS

LIGHT ON FLAT PARTS

FIG.28

EFFECT OF FIRST EXAMPLE AND SECOND EXAMPLE

TRAPEZOIDAL WAVE - TRAPEZOIDAL WAVE MODIFIED
RETURNING TIME 40%

| $V_{ave}$ \ $V_{pp}$ | 8 | 10 | 12 | 14 | 16 | 18 |
|---|---|---|---|---|---|---|
| -7.6 | | | | | | |
| -7.4 | | | | | | |
| -7.2 | | | | | | |
| -7 | | | | | | |
| -6.8 | | | | | | |
| -6.6 | | | | | | |
| -6.4 | | | | | | |
| -6.2 | × | × | × | × | | |
| -6 | × | × | △ | × | | |
| -5.8 | × | △ | ○ | × | | |
| -5.6 | △ | △ | ○ | △ | × | |
| -5.4 | △ | ○ | ○ | △ | △ | × |
| -5.2 | ○ | ○ | ○ | △ | △ | × |
| -5 | △ | ○ | ○ | ○ | △ | × |
| -4.8 | △ | ○ | ○ | ○ | △ | × |
| -4.6 | △ | ○ | ○ | ○ | △ | × |
| -4.4 | △ | △ | △ | △ | △ | × |
| -4.2 | × | × | × | × | × | × |
| -4 | | | | | | |

LIGHT ON RECESSED PARTS

WHITE SPOTS

LIGHT ON FLAT PARTS

FIG.29

EFFECT OF FOURTH EXAMPLE

TRAPEZOIDAL WAVE - TRAPEZOIDAL WAVE
RETURNING TIME 45%

| $V_{ave}$ \ $V_{pp}$ | 8 | 10 | 12 | 14 | 16 | 18 |
|---|---|---|---|---|---|---|
| -7.6 | | | | | | |
| -7.4 | | | | | | |
| -7.2 | | | | | | |
| -7 | | | | | | |
| -6.8 | | | | | | |
| -6.6 | | | | | | |
| -6.4 | | | | | | |
| -6.2 | | | | | | |
| -6 | | | × | | | |
| -5.8 | | | × | × | | |
| [illegible] | × | × | △ | × | × | |
| [illegible] | × | △ | ○ | △ | △ | |
| -5.2 | × | ○ | ○ | △ | △ | |
| -5 | × | ○ | ○ | ○ | △ | × |
| -4.8 | △ | ○ | ○ | ○ | △ | × |
| -4.6 | △ | ○ | ○ | ○ | ○ | × |
| -4.4 | × | △ | △ | △ | △ | × |
| -4.2 | × | × | × | × | × | × |
| -4 | | | | | | |

LIGHT ON RECESSED PARTS

WHITE SPOTS

LIGHT ON FLAT PARTS

FIG.30

EFFECT OF FIFTH EXAMPLE

TRAPEZOIDAL WAVE - TRAPEZOIDAL WAVE
RETURNING TIME 40%

| $V_{ave}$ \ $V_{pp}$ | 8 | 10 | 12 | 14 | 16 | 18 |
|---|---|---|---|---|---|---|
| -7.6 | | | | | | |
| -7.4 | | | | | | |
| -7.2 | | | | | | |
| -7 | | | | | | |
| -6.8 | | | | | | |
| -6.6 | | | | | | |
| -6.4 | | | | | | |
| -6.2 | × | × | × | × | | |
| | × | × | △ | × | | |
| | × | △ | ○ | × | | |
| -5.6 | △ | ○ | ○ | △ | × | |
| -5.4 | △ | ○ | ○ | △ | △ | × |
| -5.2 | ○ | ○ | ○ | ○ | △ | × |
| -5 | △ | ○ | ○ | ○ | △ | × |
| -4.8 | △ | ○ | ○ | ○ | △ | × |
| -4.6 | △ | ○ | ○ | ○ | ○ | × |
| -4.4 | △ | △ | △ | △ | △ | × |
| -4.2 | × | × | × | × | × | × |
| -4 | | | | | | |

LIGHT ON RECESSED PARTS

WHITE SPOTS

LIGHT ON FLAT PARTS

FIG.31

EFFECT OF SIXTH EXAMPLE

TRIANGLE WAVE - TRAPEZOIDAL WAVE
RETURNING TIME 32%

| $V_{ave}$ \ $V_{pp}$ | 8 | 10 | 12 | 14 | 16 | 18 |
|---|---|---|---|---|---|---|
| -7.6 | | | | | | |
| -7.4 | | | | | | |
| -7.2 | | | | | | |
| -7 | | | | | | |
| -6.8 | | × | × | × | | |
| -6.6 | × | × | △ | × | × | |
| | × | × | △ | △ | × | |
| | × | △ | ○ | ○ | × | × |
| -6 | △ | ○ | ○ | ○ | △ | × |
| -5.8 | △ | ○ | ○ | ○ | △ | × |
| -5.6 | △ | ○ | ○ | ○ | △ | × |
| -5.4 | ○ | ○ | ○ | ○ | △ | × |
| -5.2 | ○ | ○ | ○ | ○ | ○ | × |
| -5 | △ | ○ | ○ | ○ | ○ | × |
| -4.8 | △ | ○ | ○ | ○ | ○ | △ |
| -4.6 | △ | ○ | ○ | ○ | ○ | △ |
| -4.4 | △ | △ | △ | △ | △ | × |
| -4.2 | × | × | × | × | × | × |
| -4 | | | | | | |

LIGHT ON RECESSED PARTS

WHITE SPOTS

LIGHT ON FLAT PARTS

FIG.32

EFFECT OF SEVENTH EXAMPLE

TRIANGLE WAVE - TRAPEZOIDAL WAVE
RETURNING TIME 16%

| $V_{ave}$ \ $V_{pp}$ | 8 | 10 | 12 | 14 | 16 | 18 |
|---|---|---|---|---|---|---|
| -7.6 | | | | | | |
| -7.4 | | | × | × | | |
| -7.2 | | × | △ | △ | | |
| -7 | | × | △ | ○ | | |
| | | △ | ○ | ○ | | |
| | × | △ | ○ | ○ | × | |
| -6.4 | △ | ○ | ○ | ○ | × | |
| -6.2 | △ | ○ | ○ | ○ | × | × |
| -6 | ○ | ○ | ○ | ○ | △ | × |
| -5.8 | ○ | ○ | ○ | ○ | △ | × |
| -5.6 | ○ | ○ | ○ | ○ | △ | × |
| -5.4 | ○ | ○ | ○ | ○ | ○ | × |
| -5.2 | ○ | ○ | ○ | ○ | ○ | △ |
| -5 | △ | ○ | ○ | ○ | ○ | △ |
| -4.8 | △ | ○ | ○ | ○ | ○ | △ |
| -4.6 | △ | ○ | ○ | ○ | ○ | △ |
| -4.4 | △ | △ | △ | △ | △ | × |
| -4.2 | × | × | × | × | × | × |
| -4 | | | | | | |

LIGHT ON RECESSED PARTS

WHITE SPOTS

LIGHT ON FLAT PARTS

FIG.33

EFFECT OF EIGHTH EXAMPLE

TRIANGLE WAVE - TRAPEZOIDAL WAVE
RETURNING TIME 8%

| $V_{ave}$ \ $V_{pp}$ | 8 | 10 | 12 | 14 | 16 | 18 |
|---|---|---|---|---|---|---|
| -7.6 | | | | △ | | |
| -7.4 | | | × | △ | | |
| | | × | △ | ○ | | |
| | | × | ○ | ○ | | |
| -6.8 | | △ | ○ | ○ | × | |
| -6.6 | × | △ | ○ | ○ | × | |
| -6.4 | △ | ○ | ○ | ○ | △ | |
| -6.2 | △ | ○ | ○ | ○ | △ | × |
| -6 | ○ | ○ | ○ | ○ | △ | × |
| -5.8 | ○ | ○ | ○ | ○ | ○ | △ |
| -5.6 | ○ | ○ | ○ | ○ | ○ | △ |
| -5.4 | ○ | ○ | ○ | ○ | ○ | △ |
| -5.2 | ○ | ○ | ○ | ○ | ○ | △ |
| -5 | △ | ○ | ○ | ○ | ○ | △ |
| -4.8 | △ | ○ | ○ | ○ | ○ | △ |
| -4.6 | △ | ○ | ○ | ○ | ○ | △ |
| -4.4 | △ | △ | △ | △ | △ | × |
| -4.2 | × | × | × | × | × | × |
| -4 | | | | | | |

LIGHT ON RECESSED PARTS

WHITE SPOTS

LIGHT ON FLAT PARTS

FIG.34

EFFECT OF NINTH EXAMPLE

TRIANGLE WAVE - TRAPEZOIDAL WAVE
RETURNING TIME 4%

| $V_{ave}$ \ $V_{pp}$ | 8 | 10 | 12 | 14 | 16 | 18 |
|---|---|---|---|---|---|---|
| -7.6 | | | | | | |
| -7.4 | | | | | | |
| -7.2 | | | | | | |
| -7 | | | | | | |
| -6.8 | | | | | | |
| -6.6 | | | × | × | | |
| -6.4 | | | × | △ | | |
| -6.2 | | | × | △ | × | |
| -6 | | | △ | ○ | △ | |
| | | × | △ | ○ | △ | |
| | | × | ○ | ○ | △ | × |
| -5.4 | | △ | ○ | ○ | ○ | × |
| -5.2 | | △ | ○ | ○ | ○ | △ |
| -5 | × | ○ | ○ | ○ | ○ | △ |
| -4.8 | △ | ○ | ○ | ○ | ○ | △ |
| -4.6 | △ | ○ | ○ | ○ | ○ | △ |
| -4.4 | △ | △ | △ | △ | △ | × |
| -4.2 | × | × | × | × | × | × |
| -4 | | | | | | |

WHITE SPOTS

LIGHT ON RECESSED PARTS

LIGHT ON FLAT PARTS

FIG.35

EFFECT OF TENTH EXAMPLE

TRIANGLE WAVE - TRAPEZOIDAL WAVE ROUNDED
RETURNING TIME 16%

| $V_{ave}$ \ $V_{pp}$ | 8 | 10 | 12 | 14 | 16 | 18 |
|---|---|---|---|---|---|---|
| -7.6 | | | | | | |
| -7.4 | | | | | | |
| -7.2 | | | | | | |
| -7 | | | | × | | |
| -6.8 | | × | × | △ | | |
| -6.6 | × | × | △ | △ | × | |
| -6.4 | × | × | △ | ○ | × | |
| -6.2 | × | △ | ○ | ○ | × | |
| -6 | △ | ○ | ○ | ○ | × | |
| -5.8 | △ | ○ | ○ | ○ | △ | × |
| -5.6 | ○ | ○ | ○ | ○ | △ | × |
| -5.4 | ○ | ○ | ○ | ○ | △ | × |
| -5.2 | ○ | ○ | ○ | ○ | ○ | × |
| -5 | △ | ○ | ○ | ○ | ○ | × |
| -4.8 | △ | ○ | ○ | ○ | ○ | △ |
| -4.6 | △ | ○ | ○ | ○ | ○ | △ |
| -4.4 | △ | △ | △ | △ | △ | × |
| -4.2 | × | × | × | × | × | × |
| -4 | | | | | | |

LIGHT ON RECESSED PARTS

WHITE SPOTS

LIGHT ON FLAT PARTS (ELEVENTH EXAMPLE)

FIG.38

EFFECT OF ELEVENTH EXAMPLE

ASSUMING HIGH CAPACITY RETURNING TIME 12%

| $V_{ave}$ \ $V_{pp}$ | 8 | 10 | 12 | 14 | 16 | 18 |
|---|---|---|---|---|---|---|
| -7.6 | | | | | | |
| -7.4 | | | × | × | | |
| -7.2 | | × | × | × | | |
| -7 | | × | △ | △ | | |
| | | △ | △ | ○ | | |
| | × | △ | ○ | ○ | × | |
| -6.4 | △ | ○ | ○ | ○ | × | |
| -6.2 | △ | ○ | ○ | ○ | × | × |
| -6 | ○ | ○ | ○ | ○ | △ | × |
| -5.8 | ○ | ○ | ○ | ○ | △ | × |
| -5.6 | ○ | ○ | ○ | ○ | △ | × |
| -5.4 | ○ | ○ | ○ | ○ | ○ | × |
| -5.2 | ○ | ○ | ○ | ○ | ○ | △ |
| -5 | △ | ○ | ○ | ○ | ○ | △ |
| -4.8 | △ | ○ | ○ | ○ | ○ | △ |
| -4.6 | △ | ○ | ○ | ○ | ○ | △ |
| -4.4 | △ | △ | △ | △ | △ | × |
| -4.2 | × | × | × | × | × | × |
| -4 | | | | | | |

LIGHT ON RECESSED PARTS

WHITE SPOTS

LIGHT ON FLAT PARTS (TWELFTH EXAMPLE)

FIG.40

EFFECT OF TWELFTH EXAMPLE

ASSUMING LOW CAPACITY RETURNING TIME 12%

| $V_{ave}$ \ $V_{pp}$ | 8 | 10 | 12 | 14 | 16 | 18 |
|---|---|---|---|---|---|---|
| -7.6 | | | | | | |
| -7.4 | | | × | × | | |
| -7.2 | | × | × | × | | |
| -7 | | × | × | × | | |
| | | △ | △ | △ | | |
| | × | △ | ○ | △ | × | |
| -6.4 | △ | ○ | ○ | ○ | × | |
| -6.2 | △ | ○ | ○ | ○ | × | × |
| -6 | ○ | ○ | ○ | ○ | △ | × |
| -5.8 | ○ | ○ | ○ | ○ | △ | × |
| -5.6 | ○ | ○ | ○ | ○ | △ | × |
| -5.4 | ○ | ○ | ○ | ○ | ○ | × |
| -5.2 | ○ | ○ | ○ | ○ | ○ | △ |
| -5 | △ | ○ | ○ | ○ | ○ | △ |
| -4.8 | △ | ○ | ○ | ○ | ○ | △ |
| -4.6 | △ | △ | △ | △ | △ | △ |
| -4.4 | × | × | × | × | × | × |
| -4.2 | × | | | | × | × |
| -4 | | | | | | |

LIGHT ON RECESSED PARTS

WHITE SPOTS

LIGHT ON FLAT PARTS

IMAGE FORMING APPARATUS AND IMAGE FORMING METHOD

TECHNICAL FIELD

The present invention relates to an image forming apparatus and an image forming method.

BACKGROUND ART

A known image forming apparatus for transferring a toner image formed on the surface of an image carrier onto a recording medium nipped in a transfer nip is disclosed in Patent Literature 1. The image forming apparatus disclosed in Patent Document 1 forms a toner image on the surface of a drum-shaped photosensitive element functioning as an image carrier through a known electrophotographic process. An endless intermediate transfer belt that is an image carrier as an intermediate transfer body abuts against the photosensitive element, and a primary transfer nip is thus formed. The toner image formed on the photosensitive element is then primarily transferred onto the intermediate transfer belt in the primary transfer nip. A secondary transfer roller as a transfer member abuts against the intermediate transfer belt, and a secondary transfer nip is thus formed. A secondary transfer facing roller is arranged inside of the loop of the intermediate transfer belt, and the intermediate transfer belt is nipped between the secondary transfer facing roller and the secondary transfer roller. The secondary transfer facing roller arranged inside of the loop is grounded. A secondary transfer bias (voltage) is applied from a power supply to the secondary transfer roller arranged outside of the loop. In this manner, a secondary transfer field for electrostatically transferring the toner image from the secondary transfer facing roller to the secondary transfer roller is formed between the secondary transfer facing roller and the secondary transfer roller, that is, in the secondary transfer nip. The toner image on the intermediate transfer belt is then secondarily transferred onto a recording sheet fed into the secondary transfer nip at operational timing synchronized with the toner image on the intermediate transfer belt, by the effects of the secondary transfer field and a nipping pressure.

In such a structure, when a recording sheet with a highly textured surface such as washi (Japanese paper) is used, density patterns following the texture of the surface could be more easily formed in an image. These density patterns are caused because a sufficient amount of toner is not transferred onto recessed parts of the paper surface, and the image density in the recessed parts becomes thin compared with that in projected parts. In response to this issue, the image forming apparatus disclosed in Patent Literature 1 is structured to apply a superimposed bias in which a direct current voltage is superimposed over an alternating current voltage, besides a direct current voltage, as the secondary transfer bias. In Patent Literature 1, by applying such a secondary transfer bias, formations of density patterns are suppressed compared with when a secondary transfer bias consisting only of a direct current voltage is applied.

DISCLOSURE OF INVENTION

Problem to be Solved by the Invention

However, experiments conducted by inventors of the present invention have revealed that, in the conventional technology described above, when the secondary transfer bias is applied in the manner disclosed in Patent Document 1, a plurality of white spots tend to be formed more easily in an image at locations corresponding to the recessed parts of the paper surface.

An object of the present invention is to provide an image forming apparatus and an image forming method for suppressing formations of white spots and achieving high quality images, while obtaining sufficient image densities in both of the recessed parts and the projected parts of a recording medium surface.

Means for Solving Problem

The present invention includes a transfer member configured to abut against an image carrier for carrying a toner image to form a transfer nip; and a power supply configured to output a voltage for transferring the toner image on the image carrier onto a recording medium nipped in the transfer nip. The voltage alternates between a voltage for transferring the toner image from the image carrier onto the recording medium in a transfer direction and a voltage having an opposite polarity of the voltage for transferring when the toner image on the image carrier is transferred onto the recording medium. A time-averaged value ($V_{ave}$) of the voltage is set to a polarity in the transfer direction for transferring the toner image from the image carrier onto the recording medium and is set in the transfer direction side with respect to a median ($V_{off}$) between a maximum and a minimum of the voltage.

In the image forming apparatus according to the present invention, the voltage is set to satisfy A>B where A is output time of voltages in the transfer direction side with respect to the median ($V_{off}$), and B is output time of voltages in the opposite polarity side with respect to the median ($V_{off}$).

In the image forming apparatus according to the present invention, the voltage is set to satisfy $t_2>t_1$ where $t_1$ is time from a peak voltage in the transfer direction side to the median ($V_{off}$), and $t_2$ is time from the median ($V_{off}$) to a peak voltage in the opposite polarity side.

In the image forming apparatus according to the present invention, the voltage is set to satisfy $0.05<X<0.45$ where $X=B/(A+B)$.

In the image forming apparatus according to the present invention, the voltage is set to satisfy $0.10<X<0.40$ where $X=B/(A+B)$.

In the image forming apparatus according to the present invention, the power supply outputs the voltage so that the voltage having an opposite polarity of the voltage in the transfer direction side is applied for a time equal to or longer than 0.03 m/sec.

In the image forming apparatus according to the present invention, the power supply outputs the voltage so that $f>(4/d)\times v$ is satisfied, where f is a frequency [hertz], d is a nip width [millimeters] that is a length of the transfer nip in a moving direction of a surface of the image carrier, and v is a moving velocity [mm/s] of the surface of the image carrier.

In the image forming apparatus according to the present invention, the power supply outputs a direct current component and an alternating current component superimposed over the direct current component as the voltage, and performs constant current control that keeps the direct current component constant.

In the image forming apparatus according to the present invention, the power supply performs constant current control that keeps an output of a current (a peak-to-peak current) from a maximum to a minimum of the alternating current component constant.

The image forming apparatus according to the present invention includes an information obtaining unit configured to obtain information of a moving velocity of the surface of the image carrier; and a changing unit configured to change a preset target for an output current of the direct current component based on a result obtained by the information obtaining unit.

An image forming method according to the present invention includes a transfer member configured to abut against an image carrier for carrying a toner image to form a transfer nip; a power supply configured to output a voltage for transferring the toner image on the image carrier onto a recording medium nipped in the transfer nip; alternately outputting a voltage for transferring the toner image from the image carrier onto the recording medium in a transfer direction and a voltage having an opposite polarity of the voltage in the transfer direction when the toner image on the image carrier is transferred onto the recording medium; and outputting, from the power supply, voltages whose time-averaged value ($V_{ave}$) is set to a polarity in the transfer direction for transferring the toner image on the image carrier onto the recording medium and which are set in the transfer direction side with respect to a median ($V_{off}$) between a maximum and a minimum of the voltages.

In the image forming method according to the present invention, the voltages to be output from the power supply are set to satisfy A>B where A is output time of voltages in the transfer direction side with respect to the median ($V_{off}$), and B is output time of voltages in the opposite polarity side with respect to the median ($V_{off}$).

In the image forming method according to the present invention, the voltage is set to satisfy $t_2>t_1$ where $t_1$ is time from a peak voltage in the transfer direction side to the median ($V_{off}$), and $t_2$ is time from the median ($V_{off}$) to a peak voltage in the opposite polarity side.

Effect of the Invention

According to the present invention, when the toner image on the image carrier is transferred onto the recording medium nipped in a transfer nip, the voltage output from the power supply for causing the toner image on the image carrier to be transferred onto the recording medium is alternatingly switched between the transfer-direction voltage for causing the toner image to be transferred from the image carrier onto the recording medium and the voltage having the opposite polarity of the transfer-direction voltage, and the time-averaged value ($V_{ave}$) of the voltage is set to a transfer direction polarity that causes the toner image to be transferred from the image carrier onto the recording medium, and is set more in the transfer direction than a median voltage ($V_{off}$) between a maximum and a minimum of the voltage. Therefore, compared with a voltage following a sine wave or a symmetrical rectangular wave conventionally used and having the median voltage ($V_{off}$) and the time-averaged value ($V_{ave}$) at the same level, a required transfer direction voltage ($V_r$) and a sufficient time-averaged value ($V_{ave}$) can be achieved while the transfer direction voltage and the voltage of the opposite polarity ($V_t$) are kept small. In this manner, sufficient image density can be achieved in both of the recessed parts and the projected parts of a recording medium surface, while formation of white spots is avoided. Therefore, high quality images can be achieved.

BRIEF DESCRIPTION OF DRAWINGS

FIG. 27 is a diagram illustrating effects of the first comparative example, and is a diagram illustrating evaluations of an image on a recording medium under the condition of returning time of 50%.

FIG. 28 is a diagram illustrating effects of the first example and the second example, and is a diagram illustrating evaluations of an image on a recording medium under the condition of returning time of 40%.

FIG. 29 is a diagram illustrating effects of the fourth example, and is a diagram illustrating evaluations of an image on a recording medium under the condition of returning time of 45%.

FIG. 30 is a diagram illustrating effects of the fifth example, and is a diagram illustrating evaluations of an image on a recording medium under the condition of returning time of 40%.

FIG. 31 is a diagram illustrating effects of the sixth example, and is a diagram illustrating evaluations of an image on a recording medium under the condition of returning time of 32%.

FIG. 32 is a diagram illustrating effects of the seventh example, and is a diagram illustrating evaluations of an image on a recording medium under the condition of returning time of 16%.

FIG. 33 is a diagram illustrating effects of the eighth example, and is a diagram illustrating evaluations of an image on a recording medium under the condition of returning time of 8%.

FIG. 34 is a diagram illustrating effects of the ninth example, and is a diagram illustrating evaluations of an image on a recording medium under the condition of returning time of 4%.

FIG. 35 is a diagram illustrating effects of the tenth example, and is a diagram illustrating evaluations of an image on a recording medium under the condition of returning time of 16%.

FIG. 38 is a diagram illustrating effects of the eleventh example, and is a diagram illustrating evaluations of an image on a recording medium when the capacity of the power supply is large under the condition of returning time of 12%.

FIG. 40 is a diagram illustrating effects of the twelfth example, and is a diagram illustrating evaluations of an image on a recording medium when the capacity of the power supply is small under the condition of returning time of 12%.

BEST MODE(S) OF CARRYING OUT THE INVENTION

Figure 1:
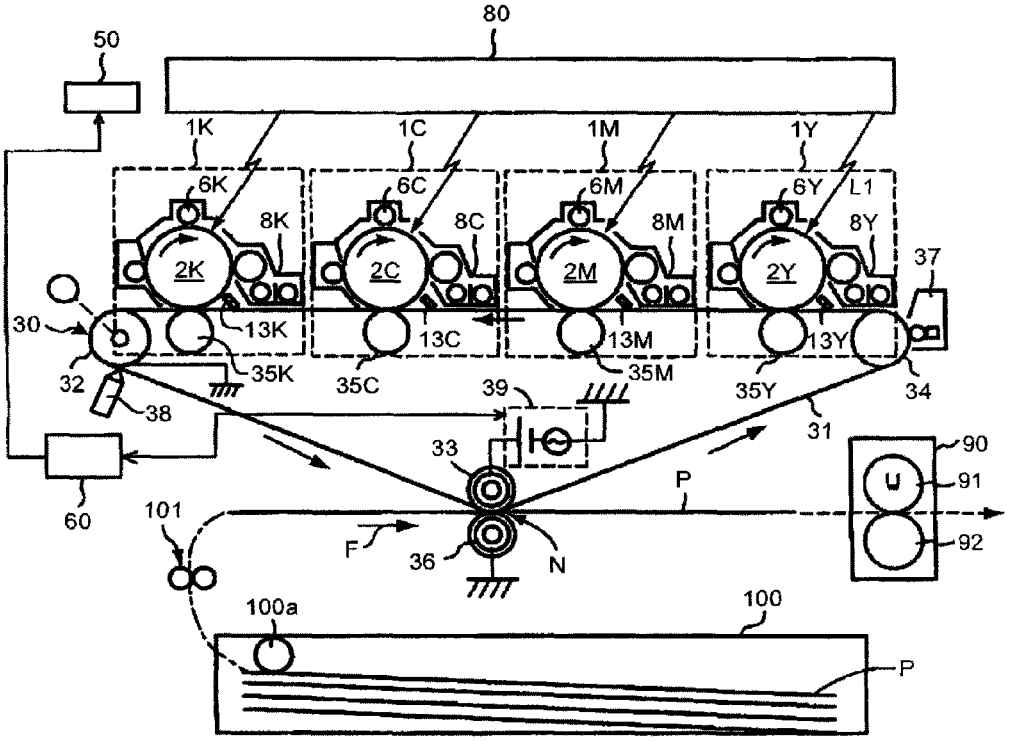
FIG. 1 is a schematic of a printer as one embodiment of an image forming apparatus according to the present invention.

As an image forming apparatus with an application of the present invention, embodiments of an electrophotographic color printer (hereinafter, simply referred to as a "printer") will now be explained below with reference to some drawings. In the embodiments, elements such as members or components having the same function or having the same shape are assigned with the same reference numerals to an extent such elements can be discriminated, and redundant explanations thereof are omitted as much as possible. It should be easy for so-called those skilled in the art to change or to modify the present invention and to achieve another embodiment within the scope specified in the appended claims. Such changes and modifications fall within the scope of the present invention. Explanations below are merely examples of the present invention, and are not intended to limit the scope of the present invention in any way.

FIG. 1 is a schematic for explaining a general structure of a printer according to the embodiment. In FIG. 1, the printer includes four image forming units 1Y, 1M, 1C, 1K for forming toner images in respective colors of yellow (Y), magenta (M), cyan (C), and black (K), a transfer unit 30 as a transfer unit, an optical writing unit 80, a fixing unit 90, a paper feeding cassette 100, a registration roller pair 101, and a control unit 60 functioning as a control unit.

Figure 2:
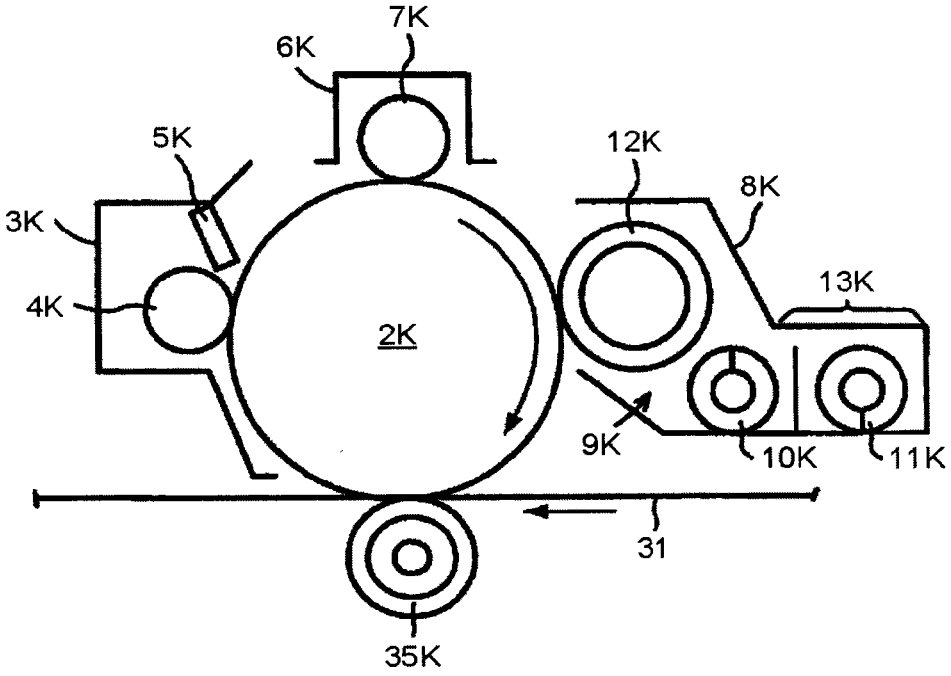
FIG. 2 is an enlarged view illustrating a general structure of an image forming unit for K included in the printer illustrated in FIG. 1.

The four image forming units 1Y, 1M, 1C, and K have the same structures, except for Y toner, M toner, C toner, and K toner in different colors are respectively used as image forming materials, and are replaced when their lifetime ends. To explain using the image forming unit 1K for forming a K toner image as an example, the image forming unit 1K includes, as illustrated in FIG. 2, a drum-shaped photosensitive element 2K as an image carrier, a drum cleaning device 3K, a neutralization device (not illustrated), a charging device 6K, and a developing device 8K. These devices in the image forming unit 1K are enclosed in a common casing, and are structured to be integrally removable from the printer main body, so that these units can be replaced all at once.

The photosensitive element 2K includes a drum-shaped base and an organic photosensitive layer formed on the surface of the base, and is driven in rotation in a clockwise direction in FIG. 1 by a driving unit not illustrated. The charging device 6K charges the surface of the photosensitive element 2K uniformly by causing discharge between a roller charger 7K and the photosensitive element 2K by bringing a roller charger 7K to which a charging bias is applied in contact with or near the photosensitive element 2K. In the printer, the photosensitive element 2K is uniformly charged to the negative polarity that is the same as a regular charged polarity of the toner. More particularly, the photosensitive element 2K is uniformly charged to approximately −650 [volts]. In this embodiment, a charging bias that is an alternating current voltage superimposed over a direct current voltage is used. The roller charger 7K includes a core metal made of metal, and a conductive elastic layer made of a conductive elastic material covering the surface of the core metal. Instead of bringing the charging member such as the roller charger in contact with or near the photosensitive element 2K, an electric charger may also be used in charging.

The surface of the photosensitive element 2K uniformly charged by the charging device 6K is optically scanned by a laser beam output from the optical writing unit 80, and carries an electrostatic latent image for K. The electric potential of the electrostatic latent image for K is approximately −100 [volts]. The electrostatic latent image for K is developed by the developing device 8K using K toner not illustrated, and becomes a K toner image. The K toner image is then primarily transferred onto an intermediate transfer belt 31 that is an intermediate transfer body, which is to be described later, being a belt-shaped image carrier.

The drum cleaning device 3K is provided to remove transfer residual toner attached to the surface of the photosensitive element 2K passed through a primary transfer process (a primary transfer nip to be described later). The drum cleaning device 3K includes a cleaning brush roller 4K driven in rotation, and a cleaning blade 5K having one end supported and the other free end abutting against the photosensitive element 2K. The drum cleaning device 3K scrapes off the transfer residual toner from the surface of the photosensitive element 2K using the rotating cleaning brush roller 4K, and removes the transfer residual toner from the surface of the photosensitive element 2K using the cleaning blade 5K. The cleaning blade 5K abuts against the photosensitive element 2K in a counter direction so that the supported end faces downstream of the free end in the rotating direction of the drum.

The neutralization device neutralizes a residual potential on the photosensitive element 2K cleaned by the drum cleaning device 3K. By performing the neutralization, the surface of the photosensitive element 2K is initialized and prepared for next image formation.

The developing device 8K includes a developing unit 12K in which a developing roll 9K is enclosed, and a developer conveying unit 13K for stirring and conveying K developer not illustrated. The developer conveying unit 13K includes a first conveying unit housing a first screw member 10K and a second conveying unit housing a second screw member 11K. Each of these screw members includes a rotating shaft member having both ends in the axial direction rotatably supported by respective shaft bearings, and spiral blades projecting from the rotating shaft in a spiral shape.

The first conveying unit housing the first screw member 10K and the second conveying unit housing the second screw member 11K are partitioned by a partitioning wall. Communicative openings for communicating these conveying units are formed on the partitioning wall near the both ends of the screws in the axial direction. The first screw member 10K stirs the K developer not illustrated held by the spiral blades in the rotating direction by being driven in rotation, to convey the K developer from the rear side to the front side in the direction perpendicular to the paper surface in FIG. 2. Because the first screw member 10K and the developing roll 9K to be explained later are arranged in parallel and facing each other, the conveying direction of the K developer corresponds to the rotational axial direction of the developing roll 9K. The first screw member 10K then supplies the K developer to the surface of the developing roll 9K in the axial direction of the first screw member 10K.

The K developer conveyed near the front end of the first screw member 10K in FIG. 2 passes through the communicative opening arranged on the partitioning wall near the front end of the first screw member 10K in FIG. 2, enters the second conveying unit, and held by the spiral blades on the second screw member 11K. As the second screw member 11K is driven in rotation, and the K developer is conveyed from the front side to the rear side in FIG. 2 while being stirred in the rotating direction of the second screw member 11K.

In the second conveying unit, a toner concentration sensor not illustrated is arranged on the bottom wall of the casing to detect the K toner concentration in the K developer in the second conveying unit. A magnetic permeability sensor is used as the K toner concentration sensor. Because the magnetic permeability of the K developer, that is, a so-called two-component developer containing K toner and magnetic carrier has a correlative relationship with the K toner concentration, the magnetic permeability sensor can detect the K toner concentration.

The printer includes toner supplying units for Y, M, C, K, not illustrated, for individually supplying toners in the colors of Y, M, C, K to the respective second housing units in the developing units for Y, M, C, K. The control unit 60 in the printer stores $V_{tref}$ for Y, M, C, K that are target voltages for outputs of the respective toner concentration detecting sensors in a random access memory (RAM) included in the control unit 60. When the difference between the output voltage of each of the toner concentration detecting sensors for Y, M, C, K and $V_{tref}$ for Y, M, C, K exceeds a predetermined level, the control unit 60 drives the toner supplying units for Y, M, C, K for a period of time corresponding to the difference. In this manner, Y, M, C, K toners are supplied to the respective second conveying units in the developing units for Y, M, C, K.

The developing roll 9K housed in the developing unit 12K not only faces the first screw member 10K, but also faces the photosensitive element 2K through an opening formed on the casing. The developing roll 9K includes a tube-like developing sleeve made from a nonmagnetic pipe and driven in rotation, and a magnet roller arranged inside of the developing sleeve and fixed so as not to be rotated by rotations of the sleeve. The surface of the developing roll 9K carries the K developer supplied by the first screw member 10K, by the magnetic force arising from the magnet roller, and supplies the K developer to a developing area facing the photosensitive element 2K as the sleeve is rotated.

Applied to the developing sleeve is a developing bias having the same polarity as the toner, and a potential higher than the electrostatic latent image on the photosensitive element 2K and lower than the electric potential of the uniformly-charged photosensitive element 2K. In this manner, a developing potential for electrostatically moving the K toner on the developing sleeve to the electrostatic latent image is generated between the developing sleeve and the electrostatic latent image on the photosensitive element 2K. Furthermore, between the developing sleeve and the bare surface of the photosensitive element 2K, a non-developing potential for moving the K toner on the developing sleeve to the surface of the sleeve is generated. By the effects of the developing potential and the non-developing potential, the K toner on the developing sleeve is selectively transferred onto the electrostatic latent image on the photosensitive element 2K, to develop the electrostatic latent image to a K toner image.

In the image forming units 1Y, 1M, 1C for Y, M, C illustrated earlier in FIG. 1, Y, M, C toner images are formed on the respective photosensitive elements 2Y, 2M, 2C, in the same manner as in the image forming unit 1K for K.

The optical writing unit 80 that is a latent image writing unit is arranged above the image forming units 1Y, 1M, 1C, 1K. The optical writing unit 80 optically scans the photosensitive elements 2Y, 2M, 2C, 2K using laser beams output from light sources such as laser diodes, based on image information transmitted by an external device, such as a personal computer. By this optical scanning, the electrostatic latent images for Y, M, C, K are formed on the respective photosensitive elements 2Y, 2M, 2C, 2K. Specifically, the electric potential is reduced at a part of the entire uniformly charged surface of the photosensitive element 2Y by being irradiated with the laser beam. In this manner, an electrostatic latent image having a smaller electric potential than the other part (bare surface) is formed as a part irradiated with the laser. The optical writing unit 80 irradiates each of the photosensitive elements with a laser beam L1 output from a light source via a plurality of optical lenses and mirrors while polarizing the light beam L in a main-scanning direction using a polygon mirror that is driven in rotation by a polygon motor not illustrated. As the optical writing unit 80, an optical writing unit that performs optical writing on the photosensitive elements 2Y, 2M, 2C, 2K using light emitting diode (LED) light output from a plurality of LEDs in a LED array may also be used.

The transfer unit 30 for moving the stretched endless intermediate transfer belt 31 in the counter-clockwise direction in FIG. 1 is arranged under the image forming units 1Y, 1M, 1C, 1K. The transfer unit 30 includes a driving roller 32, a secondary transfer rear surface roller 33, a cleaning backup roller 34, primary transfer rollers 35Y, 35M, 35C, 35K that are four primary transfer members, and a nip forming roller 36 being a transfer member, and a belt cleaning device 37, as well as the intermediate transfer belt 31 being the image carrier.

The endless intermediate transfer belt 31 is stretched across the driving roller 32, the secondary transfer rear surface roller 33, the cleaning backup roller 34, and the four primary transfer rollers 35Y, 35M, 35C, 35K arranged inside of the loop of the intermediate transfer belt 31. In the embodiment, the intermediate transfer belt 31 is driven by a rotating force of the driving roller 32 that is driven in rotation by a driving unit not illustrated in the counter-clockwise direction in FIG. 1, to be moved in the counter-clockwise direction in FIG. 1.

The primary transfer rollers 35Y, 35M, 35C, 35K and the respective photosensitive elements 2Y, 2M, 2C, 2K nip the intermediate transfer belt 31 moving. In this manner, primary transfer nips for Y, M, C, K where the front surface of the intermediate transfer belt 31 abuts against the photosensitive elements 2Y, 2M, 2C, 2K are formed. A primary transfer bias is applied to each of the primary transfer rollers 35Y, 35M, 35C, 35K by a primary transfer bias power supply not illustrated. In this manner, transfer electric fields are formed between the toner images in Y, M, C, K that are on the respective photosensitive elements 2Y, 2M, 2C, 2K and the respective primary transfer rollers 35Y, 35M, 35C, 35K. The Y toner formed on the surface of the photosensitive element 2Y for Y enters the primary transfer nip for Y as the photosensitive element 2Y is rotated. By effects of the transfer electric field and the nipping pressure, the Y toner image is moved from the photosensitive element 2Y to the intermediate transfer belt 31, to be primarily transferred. The intermediate transfer belt 31 on which the Y toner image is primarily transferred is then passed through the primary transfer nips for M, C, K sequentially. The toner images in M, C, K formed on the photosensitive elements 2M, 2C, 2K are sequentially superimposed over the Y toner image, to be primarily transferred. By superimposing primary transfers, four-color superimposed toner image is formed on the intermediate transfer belt 31.

Each of the primary transfer rollers 35Y, 35M, 35C, 35K includes a core metal made of metal, and an elastic roller having a conductive sponge layer fixed on the surface of the core metal. The primary transfer rollers 35Y, 35M, 35C, 35K are arranged so that the axial center of each of primary transfer rollers 35Y, 35M, 35C, 35K is positioned offset from the axial center of the corresponding one of the photosensitive elements 2Y, 2M, 2C, 2K by a distance of approximately 2.5 millimeters on a downstream side in the moving direction of the belt. In the printer, the primary transfer bias is applied to each of the primary transfer rollers 35Y, 35M, 35C, 35K by constant current control. A transfer charger or a transfer brush may be used as a primary transfer member instead of the primary transfer rollers 35Y, 35M, 35C, 35K.

The nip forming roller 36 in the transfer unit 30 is arranged outside of the loop of the intermediate transfer belt 31, and nips the intermediate transfer belt 31 with the secondary transfer rear surface roller 33 arranged inside of the loop. In this manner, a secondary transfer nip N where the front surface of the intermediate transfer belt 31 and the nip forming roller 36 abut against each other is formed. In the example illustrated in FIGS. 1 and 2, the nip forming roller 36 is grounded. The secondary transfer bias as a voltage is applied to the secondary transfer rear surface roller 33 from a power supply 39 for the secondary transfer bias. In this manner, a secondary transfer field is formed between the secondary transfer rear surface roller 33 and the nip forming roller 36 so that the toner having negative polarity is electrostatically moved in a direction from the secondary transfer rear surface roller 33 toward the nip forming roller 36.

The paper feeding cassette 100 storing therein a paper bundle that is a stack of a plurality of recording sheets P that is to be used as recording media is arranged under the transfer unit 31. The paper feeding cassette 100 has a paper feeding roller 100*a* abutting against the top recording sheet P in the paper bundle, and drives the paper feeding roller 100*a* in rotation at predetermined operational timing to feed the recording sheet P into a paper feeding channel. The registration roller pair 101 is arranged near the end of the paper feeding channel. The registration roller pair 101 is stopped being rotated as soon as the recording sheet P fed from the paper feeding cassette 100 is nipped between these rollers. The registration roller pair 101 is then started to be driven in rotation again at operational timing at which the recording sheet P thus nipped is synchronized with the four-color superimposed toner image formed on the intermediate transfer belt 31 in the secondary transfer nip N, and feeds the recording sheet P into the secondary transfer nip N. The four-color superimposed toner image on the intermediate transfer belt 31 attached closely to the recording sheet P in the secondary transfer nip N is secondarily transferred onto the recording sheet P altogether, by the effects of the secondary transfer field and the nipping pressure, and a full-color toner image is formed together with the white color of the recording sheet P. After the recording sheet P is passed through the secondary transfer nip N after the full-color toner image is formed on the surface in the manner described above, the recording sheet P self-strips from the nip forming roller 36 and the intermediate transfer belt 31.

The secondary transfer rear surface roller 33 includes a core metal, and a conductive nitrile butadiene rubber (NBR) based rubber layer covering the surface of the core metal. The nip forming roller 36 also includes a core metal, and a NBR-based rubber layer covering the surface of the core metal.

The power supply 39 that outputs a voltage for transferring the toner image on the intermediate transfer belt 31 onto the recording medium P nipped between the secondary transfer nip N (hereinafter, referred to as a "secondary transfer bias") is configured to include a direct current power supply and an alternating current power supply, and to output a superimposed bias in which an alternating current voltage is superimposed over a direct current voltage as the secondary transfer bias. In this embodiment, as illustrated in FIG. 1, the secondary transfer bias is applied to the secondary transfer rear surface roller 33, and the nip forming roller 36 is grounded.

Figure 3:
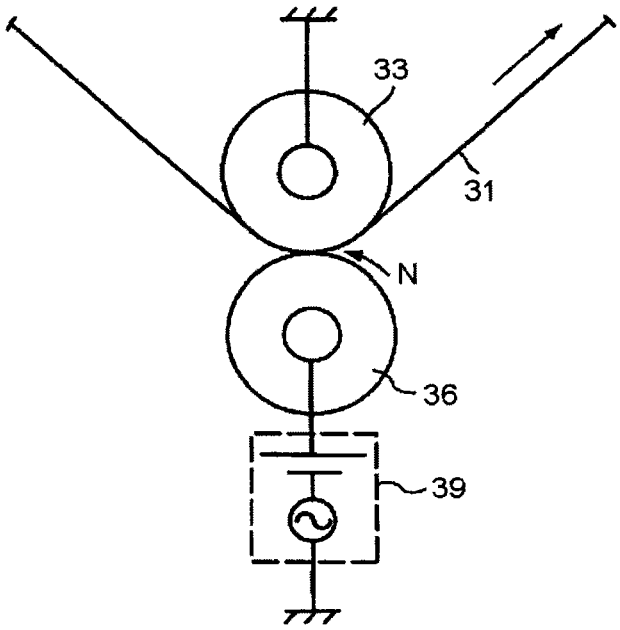
FIG. 3 is an enlarged view illustrating a configuration of a power supply and a voltage supply for secondary transfer used in the image forming apparatus illustrated in FIG. 1.

The configuration for supplying the secondary transfer bias is not limited to that illustrated in FIG. 1. The superimposed bias output from the power supply 39 may be applied the nip forming roller 36, and the secondary transfer rear surface roller 33 may be grounded, as illustrated in FIG. 3. In such a configuration, the polarity of the direct current voltage is switched. In other words, when the superimposed bias is applied to the secondary transfer rear surface roller 33, as illustrated in FIG. 1, while the toner of negative polarity is used and the nip forming roller 36 is grounded, a direct current voltage of negative polarity which is the same as the polarity of the toner is used, and a time-averaged potential of the superimposed bias is set to negative polarity that is the same polarity as that of the toner.

By contrast, when the superimposed bias is applied to the nip forming roller 36 while the secondary transfer rear surface roller 33 is grounded as illustrated in FIG. 3, a direct current voltage of positive polarity that is the opposite polarity of the toner is used, and the time-averaged potential of the superimposed bias is set to positive polarity that is opposite polarity of the toner.

Figure 4:
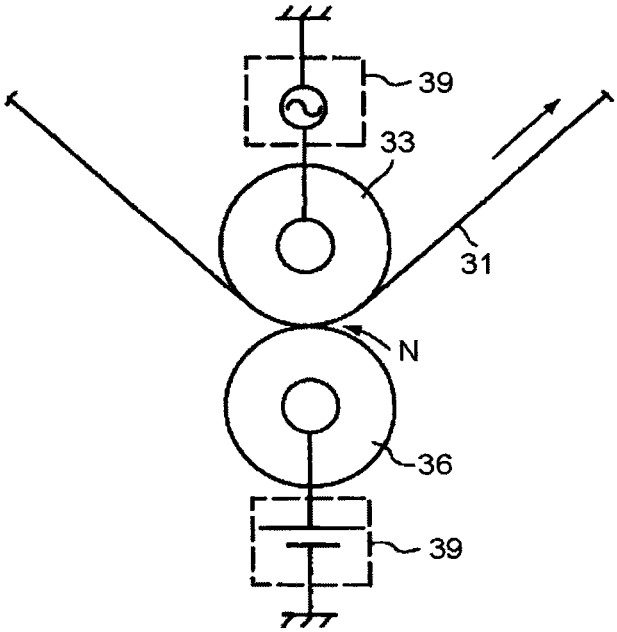
FIG. 4 is an enlarged view illustrating another configuration of the power supply and the voltage supply for the secondary transfer used in the image forming apparatus.
Figure 5:
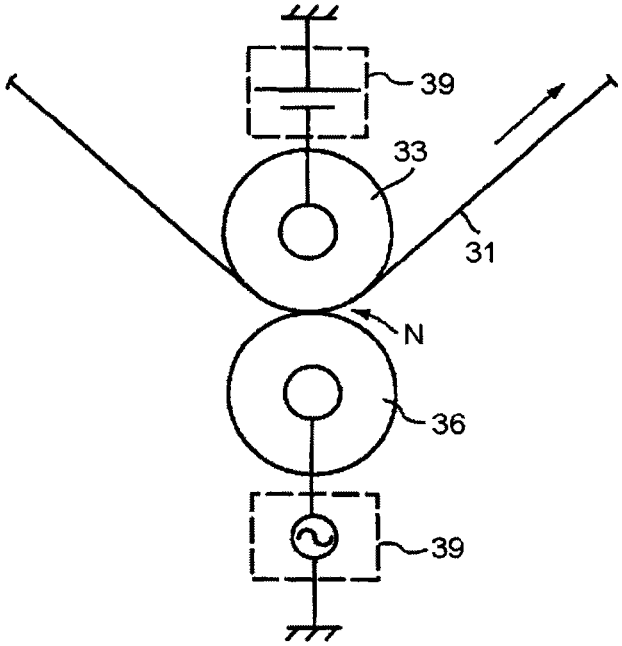
FIG. 5 is an enlarged view illustrating still another configuration of the power supply and the voltage supply for the secondary transfer used in the image forming apparatus.

As a configuration for supplying the superimposed bias used as the secondary transfer bias, a direct current voltage may be applied from the power supply 39 to one of the secondary transfer rear surface roller 33 and the nip forming roller 36, and an alternating current voltage may be applied from the power supply 39 to the other, as illustrated in FIGS. 4 and 5, instead of applying the superimposed bias to one of the secondary transfer rear surface roller 33 and the nip forming roller 36.

Figure 6:
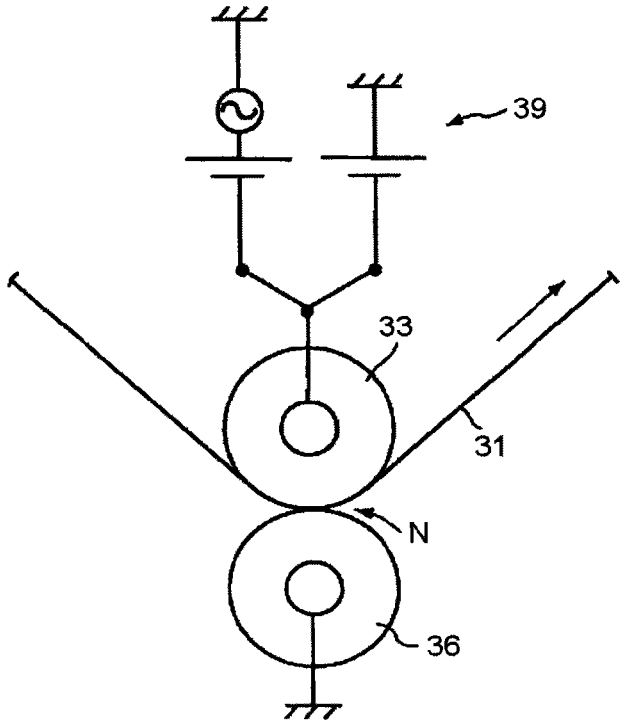
FIG. 6 is an enlarged view illustrating still another configuration of the power supply and the voltage supply for the secondary transfer used in the image forming apparatus.
Figure 7:
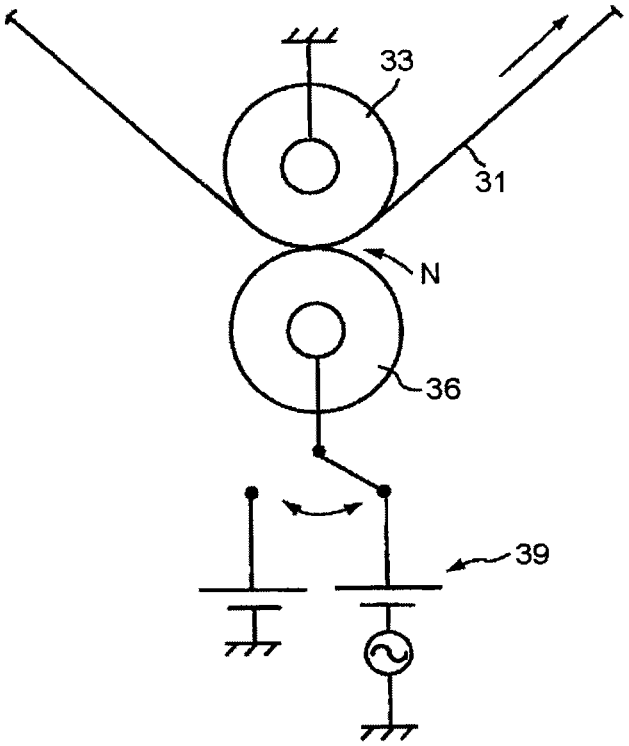
FIG. 7 is an enlarged view illustrating still another configuration of the power supply and the voltage supply for the secondary transfer used in the image forming apparatus.

The configuration for supplying the secondary transfer bias are not limited to the above, and a "direct current voltage+alternating current voltage" and a "direct current voltage" may be switched, and applied to one of the rollers, as illustrated in FIGS. 6 and 7. In the configuration illustrated in FIG. 6, the power supply 39 is switched between the "direct current voltage+alternating current voltage" and the "direct current voltage", and switched one is supplied to the secondary transfer rear surface roller 33. In the configuration illustrated in FIG. 7, the power supply 39 can be switched between the "direct current voltage+alternating current voltage" and the "direct current voltage", and selected one can be supplied to the nip forming roller 36.

Figure 8:
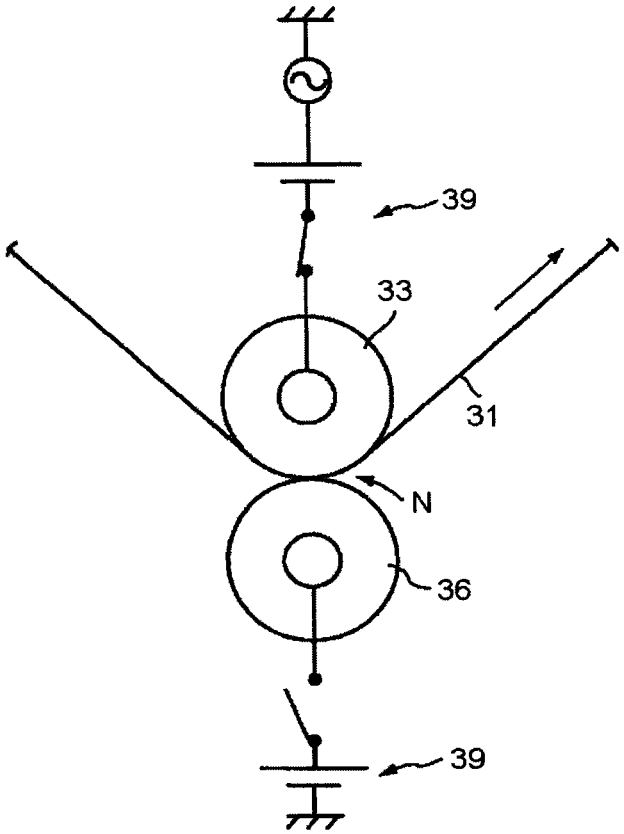
FIG. 8 is an enlarged view illustrating still another configuration of the power supply and the voltage supply for the secondary transfer used in the image forming apparatus.
Figure 9:
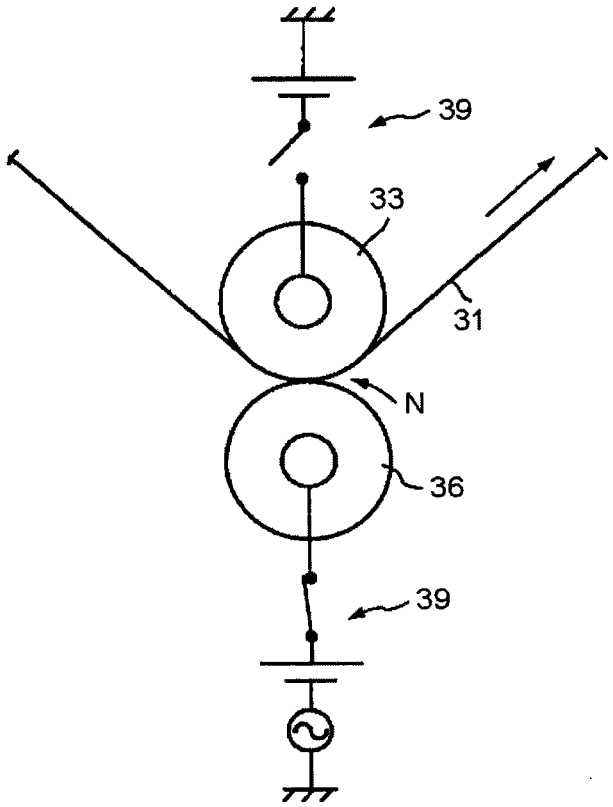
FIG. 9 is an enlarged view illustrating still another configuration of the power supply and the voltage supply for the secondary transfer used in the image forming apparatus.

As configurations for supplying the secondary transfer bias, when the "direct current voltage+alternating current voltage" and the "direct current voltage" are switched, the "direct current voltage+alternating current voltage" may be supplied to one of the rollers, and the "direct current voltage" may be supplied to the other roller, and the voltage supplies can be switched as appropriate, as illustrated in FIGS. 8 and 9. In the configuration illustrated in FIG. 8, the "direct current voltage+alternating current voltage" can be supplied to the secondary transfer rear surface roller 33, and the direct current voltage can be supplied to the nip forming roller 36. In the configuration illustrated in FIG. 9, the "direct current voltage" can be supplied to the secondary transfer rear surface roller 33, and the "direct current voltage+alternating current voltage" can be supplied to the nip forming roller 36.

In the manner described above, there are many configurations for supplying the secondary transfer bias to the secondary transfer nip N. As a power supply for achieving such configurations, appropriate power supplies may be selected based on the configurations for the supplies, including a power supply that can supply the "direct current voltage+alternating current voltage", such as the power supply 39, a power supply that can supply the "direct current voltage" and the "alternating current voltage" individually, and a power supply that can be switched to apply the "direct current voltage+alternating current voltage" and the "direct current voltage" within a single power unit. The power supply 39 used for the secondary transfer bias has a configuration that can be switched between a first mode for outputting a direct current voltage only, and a second mode for outputting a voltage in which the alternating current voltage is superimposed over the direct current voltage (superimposed voltage). In the configurations illustrated in FIG. 1 and FIGS. 3 to 5, the modes can be switched by turning the output of the alternating current voltage on and off. In the configurations illustrated in FIGS. 6 to 9, two power supplies may be used with a switching unit such as a relay, and the modes may be switched by switching these two power supplies selectively.

For example, when a recording sheet P with a less textured surface such as plain paper is used instead of using a recording sheet with a highly textured surface such as rough paper, because any density patterns following patterns of the texture will not be formed, the first mode is selected so as to apply only the direct current voltage as the secondary transfer bias. When a recording sheet P with a highly textured surface such as rough paper is used, the second mode is selected so that the alternating current voltage superimposed over the direct current voltage is output as the secondary transfer bias. In other words, the secondary transfer bias may be switched between the first mode and the second mode based on the type of a recording sheet P to be used (the degree of texture on the surface of the recording sheet P).

The transfer residual toner that is not transferred onto the recording sheet P is attached to the intermediate transfer belt 31 passed through the secondary transfer nip N. The belt cleaning device 37 abutting against the front surface of the intermediate transfer belt 31 cleans the transfer residual toner from the belt surface. The cleaning backup roller 34 arranged inside of the loop of the intermediate transfer belt 31 backs up belt cleaning performed by the belt cleaning device 37 from the inside of the loop.

The fixing unit 90 is arranged on the right side in FIG. 1 that is downstream of the secondary transfer nip N in the conveying direction of the recording sheet. In the fixing unit 90, a fixing nip is formed between a fixing roller 91 in which a heat source such as a halogen lamp is internalized, and a pressing roller 92 being rotated in a manner abutting against the fixing roller 91 at a given pressure. The recording sheet P fed into the fixing unit 90 is nipped in the fixing nip in an orientation where the surface carrying an unfixed toner image adheres to the fixing roller 91. The toner in the toner image is softened by effects of being heated and pressed, and the full color image is fixed. The recording sheet P discharged from the fixing unit 90 is passed through a post-fixing conveying channel, and is discharged from the apparatus.

In the printer, a normal mode, a high image quality mode, and a high speed mode are specified in the control unit 60. The process linear velocity (the linear velocity of the photosensitive elements or the intermediate transfer belt) in the normal mode is set to approximately 280 [mm/s]. In the high image quality mode in which the high image quality is prioritized over a printing speed, the process linear velocity is set lower than that of the normal mode. In the high speed mode in which the printing speed is prioritized over the image quality, the process linear velocity is set higher than that of the normal mode. The normal mode, the high image quality mode, and the high speed mode are switched based on a user key operation performed on an operation panel 50 (see FIG. 16) provided to the printer, or through a printer property menu on a personal computer connected to the printer.

In the printer, when a monochromatic image is to be formed, a reciprocable support plate not illustrated and supporting the primary transfer rollers 35Y, 35M, 35C for Y, M, C in the transfer unit 30 is moved so that the primary transfer rollers 35Y, 35M, 35C are moved away from the respective photosensitive elements 2Y, 2M, 2C. In this manner, the front surface of the intermediate transfer belt 31 is moved away from the photosensitive elements 2Y, 2M, 2C, and the intermediate transfer belt 31 is kept abutting against the photosensitive element 2K for K. In this arrangement, only the image forming unit 1K for K is driven, among the four image forming units 1Y, 1M, 1C, 1K, to form the K toner image on the photosensitive element 2K.

In the printer, the direct current component in the secondary transfer bias is the time-averaged value ($V_{ave}$) of the voltage, that is, a voltage averaged over time (time-averaged value) $V_{ave}$ being the voltage of the direct current component. The time-averaged value $V_{ave}$ of the voltage is an integral of a voltage waveform of one cycle divided by the length of one cycle.

In the printer in which the secondary transfer bias is applied to the secondary transfer rear surface roller 33 and the nip forming roller 36 is grounded, when the polarity of the secondary transfer bias is negative that is the same polarity as the toner, the toner of negative polarity is electrostatically pushed away from the secondary transfer rear surface roller 33 toward the nip forming roller 36 in the secondary transfer nip N. In this manner, the toner on the intermediate transfer belt 31 is transferred onto the recording sheet P. By contrast, when the polarity of the superimposed bias is positive that is opposite polarity of the toner, the toner having negative polarity is electrostatically attracted from the nip forming roller 36 to the secondary transfer rear surface roller 33 in the secondary transfer nip N. In this manner, the toner transferred onto the recording sheet P is attracted back to the intermediate transfer belt 31.

When a recording sheet P with a highly textured surface such as washi is used, density patterns following the texture of the surface could be formed in an image more easily. Therefore, in Patent Literature 1, a superimposed bias in which a direct current voltage superimposed over an alternating current voltage is applied as the secondary transfer bias, as well as a direct current voltage.

Figure 10:
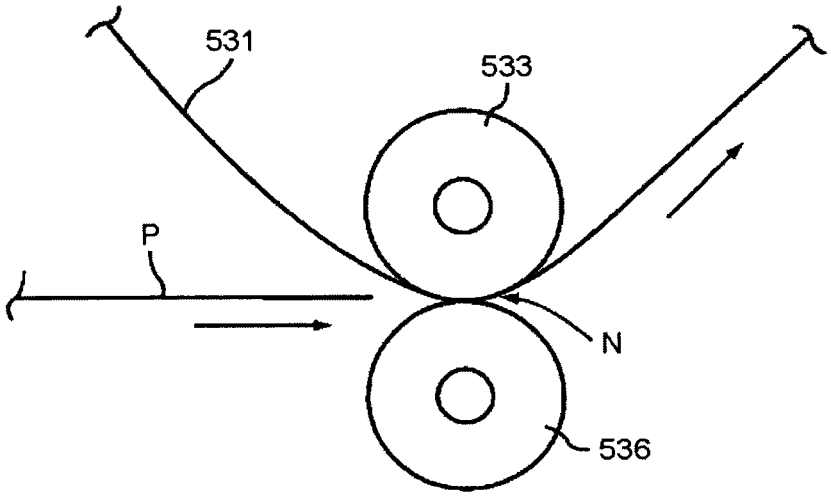
FIG. 10 is an enlarged view of a configuration of an example of a secondary transfer nip.

However, based on some experiments, the inventors found out that in such a configuration, a plurality of white spots tend to be formed more easily in the image at locations corresponding to recessed parts of the paper surface. In response to this issue, the inventors dedicatedly conducted some studies on causes of the white spots, and found out what is described below. FIG. 10 is a conceptual schematic schematically illustrating an example of the secondary transfer nip N. In FIG. 10, an intermediate transfer belt 531 is pressed against a nip forming roller 536 by a secondary transfer rear surface roller 533 abutting against the rear surface of the intermediate transfer belt 531. By this pressing force, the secondary transfer nip N is formed where the front surface of the intermediate transfer belt 531 and the nip forming roller 536 abut against each other. A toner image on the intermediate transfer belt 531 is secondarily transferred onto the recording sheet P fed into the secondary transfer nip N. The secondary transfer bias for secondarily transferring the toner image is applied to one of the two rollers illustrated in FIG. 10, and the other roller is grounded. To transfer the toner image to the recording sheet P, the transfer bias may be applied to either one of the rollers. Explained below is an example in which the secondary transfer bias is applied to the secondary transfer rear surface roller 533 and the toner of negative polarity is used. In such an example, to move the toner in the secondary transfer nip N from the side of the secondary transfer rear surface roller 533 to the side of the nip forming roller 536, a superimposed bias with a time-averaged potential at negative polarity, which is the same polarity as the toner, is applied as the secondary transfer bias.

Figure 11:
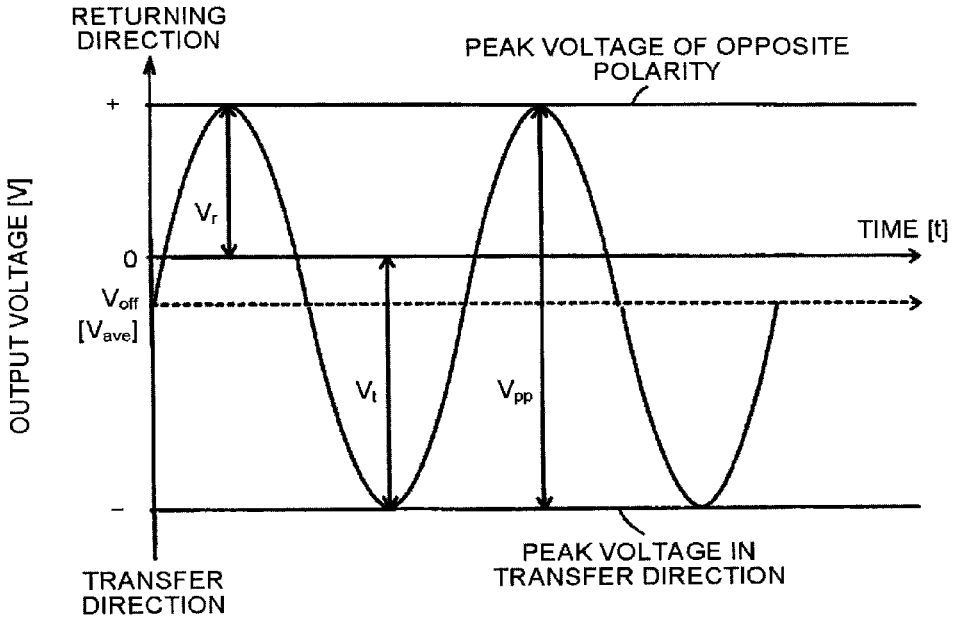
FIG. 11 is a waveform chart for explaining a waveform of a voltage configured as a superimposed bias.

FIG. 11 is a schematic of an example of a waveform of the secondary transfer bias consisting of a superimposed bias applied to the secondary transfer rear surface roller 533. In FIG. 11, the voltage averaged over time (hereinafter, referred to as a "time-averaged value") $V_{ave}$ [volts] represents a time-averaged value of the secondary transfer bias. As illustrated, the secondary transfer bias consisting of a superimposed bias follows the form of a sine wave with a peak in a returning direction side and a peak in a transfer direction side, as illustrated in FIG. 11. Among these two peaks, appended with a reference sign of $V_t$ is a peak voltage in the direction causing the toner to move from the belt toward the nip forming roller 536 (in the transfer direction side) in the secondary transfer nip N (hereinafter, referred to as a "transfer direction peak voltage $V_t$"). In FIG. 11, $V_r$ is a peak in the direction that causes the toner to move back from the side of the nip forming roller 536 toward the belt (in the returning direction side) (hereinafter, referred to as a returning peak voltage $V_r$). To cause the toner to be reciprocated between the belt and the recording sheet in the secondary transfer nip N, an alternating current bias consisting only of an alternating current component may also be applied, instead of the superimposed bias illustrated. However, the alternating current bias can only cause the toner to be reciprocated, and the alternating current bias alone cannot transfer the toner onto the recording sheet P. By applying a superimposed bias containing a direct current component and bringing the time-averaged voltage $V_{ave}$ [volts] that is a time-averaged value of the superimposed bias to negative polarity that is the same polarity as the toner, the toner can be moved relatively from the belt side to the recording sheet P side and be transferred onto the recording sheet P, while being reciprocated.

The inventors observed reciprocations, and found out the following. When the secondary transfer bias was started being applied, only a small amount of toner particles existing on the surface of a toner layer on the intermediate transfer belt 531 started separating from the toner layer, and moved toward the recessed parts of the surface of the recording sheet. However, the most of the toner particles in the toner layer remained in the toner layer. The small amount of toner particles separated from the toner layer entered into the recessed parts of the recording sheet surface, and, when the directions of the electric field was reversed, the toner particles moved back from the recessed parts to the toner layer. At this time, the returning toner particles collided with the toner particles remaining in the toner layer, to reduce the adhesive force of the toner particles to the toner layer (or to the recording sheet). When the electric field was reversed again to the direction toward the recording sheet P, a larger amount of toner particles separated from the toner layer, and moved toward the recessed parts of the recording sheet surface. It has been found out that, by repeating such a series of behaviors, the number of toner particles separated from the toner layer and entered into the recessed parts of the recording sheet surface was increased, and a sufficient amount of toner particles was transferred onto the recessed parts.

In a configuration in which the toner particles are reciprocated in the manner described above, unless the returning peak voltage $V_r$ illustrated in FIG. 11 is set to somewhat high, the toner particles entered into the recessed parts of the recording sheet surface could not be sufficiently attracted back to the toner layer of the belt, and the image density might not be sufficient in the recessed parts. Furthermore, unless the time-averaged value $V_{ave}$ [volts] of the secondary transfer bias is set somewhat high, a sufficient amount of toner cannot be transferred onto the projected parts of the recording sheet surface, and the image density might be insufficient in the projected parts. To achieve a sufficient image density on both of the projected parts and the recessed parts of the recording sheet surface, a voltage between returning peak voltage $V_r$ and the transfer direction peak voltage $V_t$ that is the width between the maximum voltage and the minimum voltage (hereinafter, referred to as a "peak-to-peak voltage") $V_{pp}$ needs to be set to a relatively high voltage, so that both of the time-averaged value $V_{ave}$ [volts] and the returning peak voltage $V_r$ become somewhat high. The transfer direction peak voltage $V_t$ will then naturally set to a relatively high voltage. The transfer direction peak voltage Vt corresponds to the maximum difference between the potential of the nip forming roller 536 that is grounded and the potential of the secondary transfer rear surface roller 533 to which the secondary transfer bias is applied. Therefore, when the transfer direction peak voltage $V_t$ is brought to a higher level, discharge can occur more easily between these rollers. In particular, discharge can occur more easily in a very small space formed between the intermediate transfer belt and the recessed parts of the recording sheet surface, and white spots could be formed more easily in parts of the image corresponding to the recessed parts. It was found out that, by setting the peak-to-peak voltage $V_{pp}$ to a relatively high voltage to achieve sufficient image density in both of the projected parts and the recessed parts of the recording sheet surface, white spots were formed more easily in parts of the image corresponding to the recessed parts of the recording sheet surface.

Observation experiments conducted by the inventors will now be explained in detail.

Figure 12:
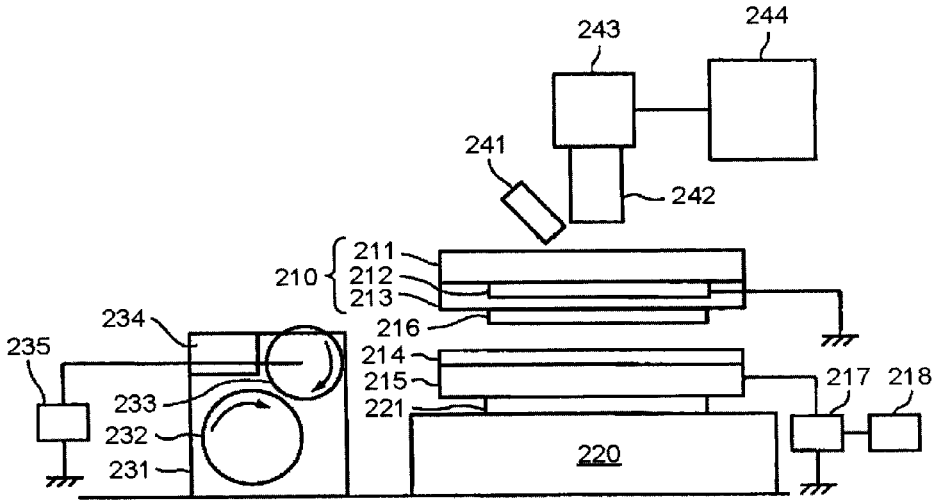
FIG. 12 is a schematic illustrating a general configuration of observation experimental equipment used in experiments.

To observe toner behaviors in the secondary transfer nip N, the inventors manufactured special observation experiment equipment. FIG. 12 is a general schematic of a structure of the observation experiment equipment. The observation experiment equipment includes a transparent substrate 210, a developing unit 231, a Z-axis stage 220, an illumination 241, a microscope 242, a high speed camera 243, and a personal computer 244. The transparent substrate 210 includes a glass plate 211, transparent electrodes 212 formed under the glass plate 211 and made of indium tin oxide (ITO), and a transparent insulating layer 213 covering the transparent electrodes 212 and made of a transparent material. The transparent substrate 210 is supported by a substrate support not illustrated at a predetermined height. The substrate support is structured to be movable by a moving mechanism not illustrated in the vertical and the horizontal directions in FIG. 12. In the arrangement illustrated, the transparent substrate 210 is positioned above the Z-axis stage 220 on which a metal plate 215 is placed. However, the transparent substrate 210 can be moved directly above the developing unit 231, which is arranged by the Z-axis stage 220, by moving the substrate support. The transparent electrodes 212 on the transparent substrate 210 are connected to electrodes fixed to the substrate support, and these electrodes are grounded.

The developing unit 231 has the same structure as that of the developing unit included in the printer according to the embodiment, and includes a screw member 232, a developing roll 233, and a doctor blade 234. The developing roll 233 is driven in rotation while a developing bias is applied by a power supply 235.

When the substrate support is moved to move the transparent substrate 210 at a given velocity to a position directly above the developing unit 231 and facing the developing roll 233 with a given gap therebetween, the toner on the developing roll 233 is transferred onto the transparent electrodes 212 in the transparent substrate 210. In this manner, a toner layer 216 with a given thickness is formed on the transparent electrodes 212 in the transparent substrate 210. The amount of attached toner per unit area of the toner layer 216 can be adjusted based on the toner concentration in the developer, the amount of charge in the toner, the developing bias, the gap formed between the substrate 210 and the developing roll 233, the moving velocity of the transparent substrate 210, and the rotation speed of the developing roll 233.

The transparent substrate 210 on which the toner layer 216 is formed is moved in parallel to a position facing a recording sheet 214 that is pasted on the flat metal plate 215 with a conductive adhesive. The metal plate 215 is placed on a substrate 221 having a weight sensor not illustrated, and the substrate 221 is placed on the Z-axis stage 220. The metal plate 215 is connected to a voltage amplifier 217. A waveform generator 218 inputs a transfer bias consisting of a direct current voltage and an alternating current voltage to the voltage amplifier 217, and a transfer bias amplified by the voltage amplifier 217 is applied to the metal plate 215. When the metal plate 215 is elevated by controlling the driving of the Z-axis stage 220, the recording sheet 214 starts to be brought in contact with the toner layer 216. When the metal plate 215 is further elevated, the pressure applied to the toner layer 216 is increased. A control is then applied to stop elevating the metal plate 215 when the output of the weight sensor reaches a given level. While the pressure is at the given level, the transfer bias is applied to the metal plate 215, and the toner behaviors are then observed. After the toner behaviors are observed, a control is performed to drive the Z-axis stage 220 to bring down the metal plate 215, and the recording sheet 214 is separated from the transparent substrate 210. At this time, the toner layer 216 is already transferred onto the recording sheet 214.

The toner behaviors are observed using the microscope 242 and the high speed camera 243 arranged above the transparent substrate 210. Because the transparent substrate 210 is made from the glass plate 211, the transparent electrodes 212, and the transparent insulating layer 213 each layer of which is made of a transparent material, the behaviors of the toner located under the transparent substrate 210 can be observed through the transparent substrate 210 from above.

As the microscope 242, a microscope having a zoom lens VH-Z75 manufactured by Keyence Corporation was used. As the high speed camera 243, FASTCAM-MAX 120KC manufactured by Photoron Limited was used. The personal computer 244 controls driving of FASTCAM-MAX 120KC manufactured by Photoron Limited. The microscope 242 and the high speed camera 243 are supported by a camera support not illustrated. The camera support is structured to allow the focal point of the microscope 242 to be adjusted.

Behaviors of the toner on the transparent substrate 210 were captured in the manner described below. To begin with, a position at which the toner behaviors are to be observed was irradiated with illumination light using the illumination 241, and the focal point of the microscope 242 was adjusted. The transfer bias was then applied to the metal plate 215 so as to move the toner in the toner layer 216 attached to the bottom surface of the transparent substrate 210 to the recording sheet 214. The toner behaviors at this time were then captured by the high speed camera 243.

Because the structure of the transfer nip for transferring the toner onto the recording sheet is different between the observation experiment equipment illustrated in FIG. 12 and the printer according to the embodiment, the transfer electric field affecting the toner became different although the same transfer bias was used. To examine appropriate conditions for observations, the inventors examined the conditions of a transfer bias for achieving high density reproducibility in the recessed parts using the observation experiment equipment.

As the recording sheet 214, FC washi type "Sazanami" manufactured by NBS Ricoh Company Limited was used. As the toner, Y toner with an average particle diameter of 6.8 [micrometers] mixed with a small amount of K toner was used. Because the observation experiment equipment has a configuration in which the transfer bias is applied to the rear surface of the recording sheet (Sazanami), the polarity of the transfer bias for enabling the toner to be transferred onto the recording sheet was opposite to that used in the printer according to the embodiment (in other words, positive polarity). As an alternating current component of a superimposed bias as the secondary transfer bias, an alternating current with a sine wave waveform was used. The frequency f of the alternating current component was set to 1000 [hertz], the direct current component (corresponding to the time-averaged value $V_{ave}$, in this example) was set to 200 [volts], the peak-to-peak voltage $V_{pp}$ was set to 1000 [volts], and the toner layer 216 was transferred onto the recording sheet 214 in the amount of attached toner of 0.4 to 0.5 [mg/cm$^2$]. As a result, a sufficient image density could be achieved on the recessed parts of the surface of "Sazanami".

At this time, the focal point of the microscope 242 was adjusted to the toner layer 216 in the transparent substrate 210, and the toner behaviors were captured. The following phenomenon was then observed. While the toner particles from the toner layer 216 reciprocated between the transparent substrate 210 and the recording sheet 214 because of the alternating current field generated by the alternating current component of the transfer bias, when the number of reciprocations increased, the amount of reciprocated toner particles also increased.

Figure 13:
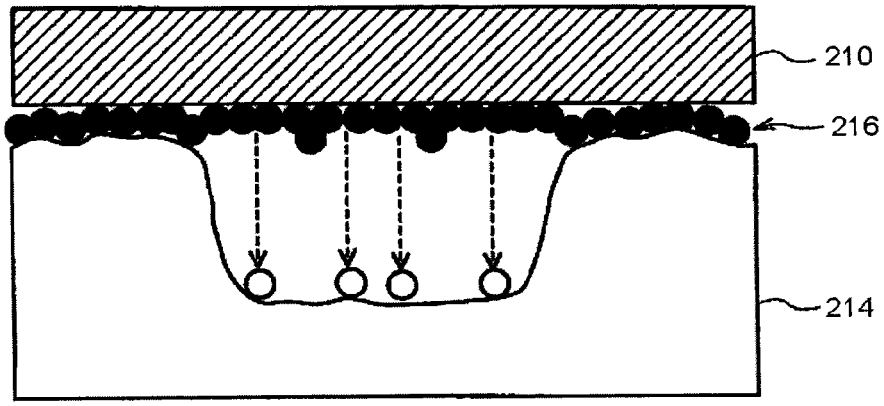
FIG. 13 is an enlarged schematic illustrating a toner behavior at an early stage of transfer in the secondary transfer nip.
Figure 14:
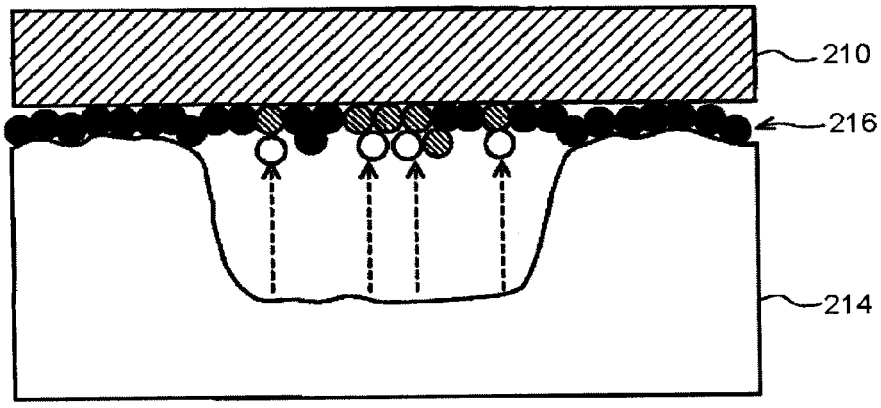
FIG. 14 is an enlarged schematic illustrating a toner behavior at a middle stage of the transfer in the secondary transfer nip.
Figure 15:
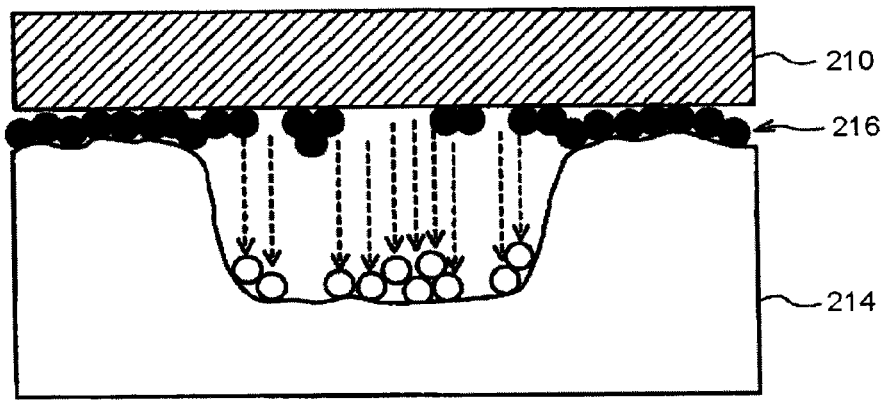
FIG. 15 is an enlarged schematic illustrating a toner behavior at a later stage of the transfer in the secondary transfer nip.

Specifically, in the transfer nip, every time one cycle (1/f) of the alternating current component of the secondary transfer bias arrived, the alternating current field affected the toner particles once, to cause the toner particles to be reciprocated between the transparent substrate 210 and the recording sheet 214 once. In the first one cycle, as illustrated in FIG. 13, only the toner particles located on the surface of the toner layer 216 were separated from the layer. After the toner particles entered into the recessed parts of the recording sheet 216, the toner particles returned to the toner layer 216. At this time, the returning toner particles collided with the toner particles in the toner layer 216. In this manner, the adhesive force of the latter toner particles to the toner layer 216 or to the transparent substrate 210 was reduced. In the same manner, in the next one cycle, as illustrated in FIG. 14, a larger amount of toner particles was separated from the toner layer 216 than that in the previous one cycle. After entering into the recessed parts of the recording sheet 216, the toner particles returned to the toner layer 216 again. At this time, the returning toner particles collided with the toner particles still remaining in the toner layer 216, and reduced the adhesive force of the latter toner particles to the toner layer 216 or to the transparent substrate 210. In the same manner, in the next one cycle, a further larger amount of toner particles was separated from the toner layer 216 than that in the previous one cycle as illustrated in FIG. 15. In the manner described above, every time the toner particles reciprocated, the number of the toner particles increased. The inventor found out that, by the time the nip passing time has elapsed (by the time when time equivalent to the nip passing time has elapsed in the observation experiment equipment), a sufficient amount of toner was transferred onto the recessed parts of the recording sheet P.

The toner behaviors were then captured under the conditions of a direct current voltage (corresponding to the time-averaged value $V_{ave}$, in this example) set to 200 [volts] and a peak-to-peak voltage $V_{pp}$ between the positive end and the negative end of the bias in one cycle (the returning side and the transfer direction, in this example) set to 800 [volts]. The following phenomenon was then observed. Only the toner particles on the surface in the toner layer 216 were separated from the layer, and entered into the recessed parts of the recording sheet P in the first one cycle. However, the toner particles entered into the recessed parts remained in the recessed parts without returning to the toner layer 216. When the next one cycle arrives, the amount of toner particles newly separated from the toner layer 216 and entered into the recessed parts of the recording sheet P was very small. Therefore, by the time the nip passing time elapsed, only a small amount of toner particles was transferred onto the recessed parts of the recording sheet P.

The inventors conducted another observation experiment, and found out that a level of the returning peak voltage $V_r$ at which the toner particles traveled from the toner layer 216 into the recessed parts of the recording sheet P in the first cycle could be attracted back to the toner layer 216 was dependent on the amount of attached toner per area of the transparent substrate 210. In other words, when the amount of attached toner on the transparent substrate 210 increased, the returning peak voltage $V_r$ at which the toner particles in the recessed parts of the recording sheet 214 could be attracted back to the toner layer 216 had to be higher.

Characterizing structures of the printer will now be explained.

Figure 16:
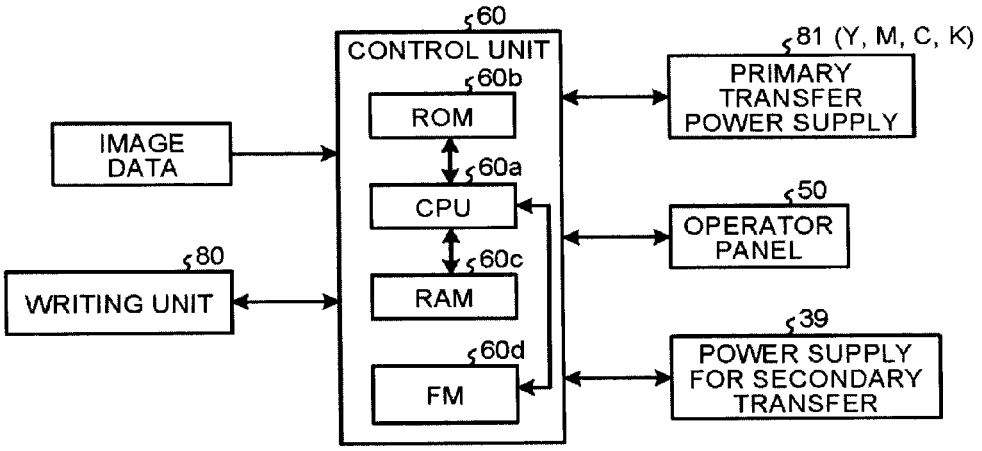
FIG. 16 is a block diagram illustrating a configuration of a control system of the printer illustrated in FIG. 1.

FIG. 16 is a block diagram illustrating a part of a controlling system included in the printer illustrated in FIG. 1. In FIG. 16, the control unit 60 that is a part of a transfer bias output unit includes a central processing unit (CPU) 60*a* that is a computing unit, a random access memory (RAM) 60*c* that is a non-volatile memory, a read-only memory (ROM) 60*b* that is a temporary storage unit, and a flash memory 60*d*. To the control unit 60 governing controlling of the entire printer, various devices and sensors are electrically connected. However, in FIG. 16, only the devices related to the characterizing structures of the printer are illustrated.

A primary transfer power supply 81 (Y, M, C, K) outputs a primary transfer bias to be applied to the primary transfer rollers 35Y, 35M, 35C, 35K. A power supply 39 for the secondary transfer outputs the secondary transfer bias to be supplied to the secondary transfer nip N. In this embodiment, the power supply 39 outputs the secondary transfer bias to be applied to the secondary transfer rear surface roller 33. The power supply 39 makes up the transfer bias output unit together with the control unit 60. An operator panel 50 includes a touch panel and a plurality of key buttons not illustrated, and can display an image on a touch panel screen, and has a function of receiving input operations made via the touch panel or the key buttons performed by an operator, and transmitting information thus input to the control unit 60. The operator panel 50 can display an image onto a touch panel based on a controlling signal received from the control unit 60.

In the present invention, it is essential for the time-averaged value ($V_{ave}$) of the voltage of the alternating current component of the secondary transfer bias to be more in a transfer direction than a median voltage $V_{off}$ between the maximum voltage and the minimum voltage of the alternating current component (the median between the maximum voltage and the minimum voltage). To realize such a voltage, it is necessary to make a waveform having a smaller area on the returning direction than on the transfer direction, with respect to the median voltage $V_{off}$ of the alternating current component. The time-averaged value is a time-averaged value of the voltage, and is an integral of voltage waveform over one cycle divided by the length of one cycle.

Figure 17:
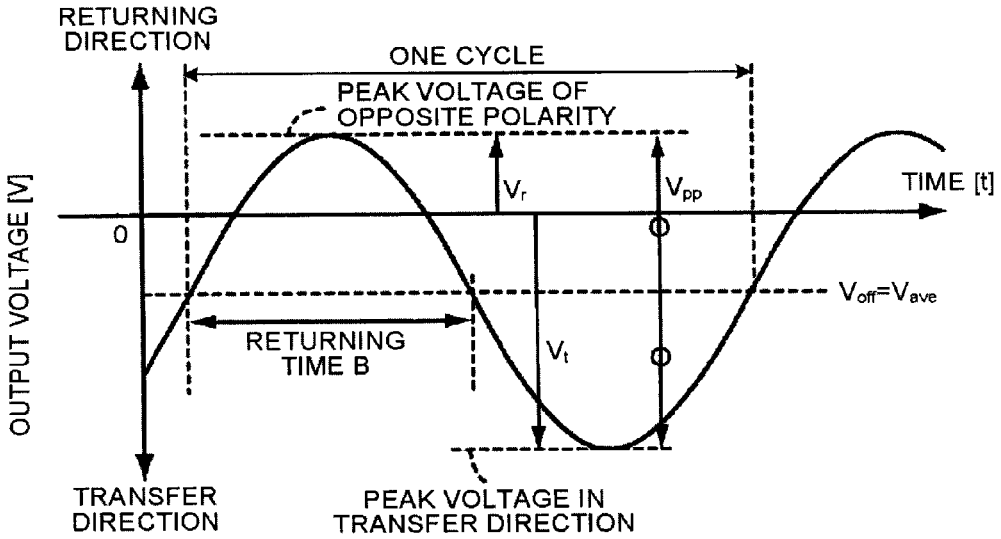
FIG. 17 is a schematic illustrating a voltage waveform of a secondary transfer bias output from a power supply according to a first comparative example.

A possible approach for achieving such a waveform is to make a gradient of a rise and a fall of a returning direction voltage larger than a gradient of a rise and a fall of the transfer direction voltage, for example, as illustrated in FIG. 17. As a value for representing a relationship between the median voltage $V_{off}$ and the time-averaged value $V_{ave}$ of the voltage, a returning time [%] is defined as the rate of the entire alternating current waveform occupied by an area on the returning side of the median voltage $V_{off}$.

Experiments conducted by the inventors and more characterizing structures of the printer according to the embodiment will now be explained.

First Experiment

The inventors prepared a print tester having the same structure as that of the printer according to the embodiment. Using the printer, the inventors conducted various printing tests after setting each device in the manner descried below.

- The process linear velocity that is the linear velocity of each of the photosensitive elements and the intermediate transfer belt 31: 173 [mm/s]
- The frequency f of the alternating current component of the secondary transfer bias: frequency is 500 [hertz]
- The recording sheet P: Leathac 66 (product name) manufactured by Tokushu Paper Manufacturing Co., Ltd., 175-kilogram paper sheets (the weight of 1000 sheets each in a size of 788 millimeters by 1091 millimeters)
- Leathac 66 is paper having a more textured surface than "Sazanami". The depth of the recessed parts on the paper surface is approximately 100 [micrometers] at the maximum. A solid blue image obtained by superimposing a solid M image and a solid C image over one another was output onto Leathac 66 under various conditions of the secondary transfer bias. The solid blue images output using various peak-to-peak voltages $V_{pp}$ and time-averaged values $V_{ave}$ are illustrated in FIGS. 27 to 35. In these charts, both of "○" and "●" are represented as "○", both of "□" and "Δ" are represented as "Δ", and "x" is represented as "x" for both of the recessed parts and the projected parts.

The test was conducted in environments of temperature of 10 degrees Celsius/humidity of 15%.

As the power supply that is a bias applying unit, a function generator (FG300 manufactured by Yokogawa Electric Corporation) is used to generate a waveform, and the waveform was amplified by 1000 times using an amplifier (Trek High Voltage Amplifier Model 10/40), and applied to the secondary transfer rear surface roller 533 illustrated in FIG. 10.

First Comparative Example

A conventional sine wave was used as the alternating current component explained in FIG. 11, and the waveform of the comparative example is illustrated in FIG. 17. In the first comparative example, the returning time was set to 50%, and the effects are illustrated in FIG. 27. In all of the peak-to-peak voltages $V_{pp}$ and the time-averaged values $V_{ave}$ illustrated in FIG. 17, the median voltage $V_{off}$=time-averaged value $V_{ave}$ of the alternating current component.

First Example

Figure 18:
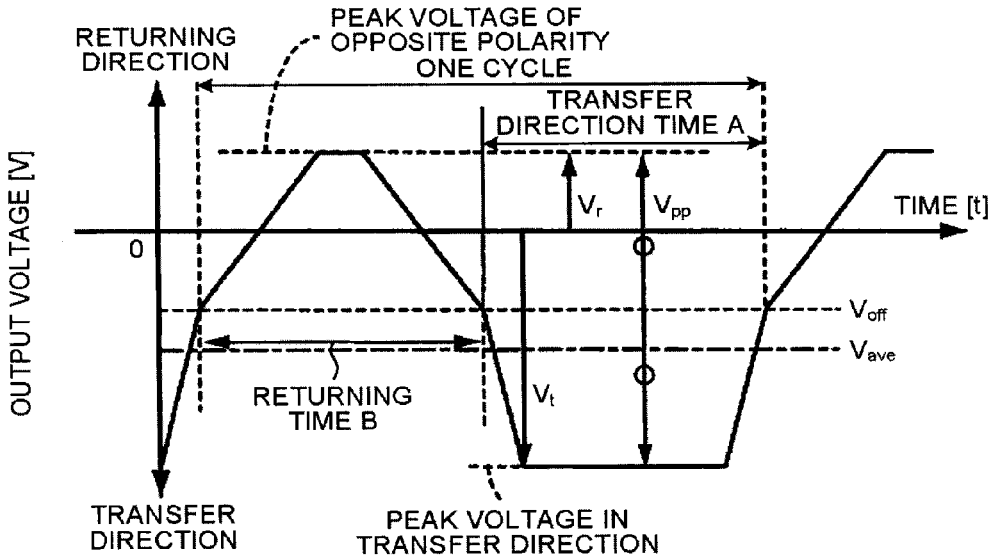
FIG. 18 is a schematic illustrating a voltage waveform of a secondary transfer bias output from a power supply according to a first example.

In the alternating current component, a gradient of a rise and a fall of the returning-direction voltage was set smaller than a gradient of a rise and a fall of the transfer direction voltage. In other words, the alternating current component was set A>B where A is transfer direction time that is output time of a voltage more in the transfer direction than the median voltage $V_{off}$, and B is a returning time that is output time of a voltage more in an opposite polarity of the transfer direction than the median voltage $V_{off}$. The waveform at this time is illustrated in FIG. 18. The returning time was then set to 40%, and the effects are illustrated in FIG. 28.

In FIG. 28, the peak-to-peak voltage $V_{pp}$=12 kilovolts, and the time-averaged value $V_{ave}$ of the voltage=−5.4 kilovolts, the median voltage $V_{off}$ of the alternating current component=−4.0 kilovolts.

Second Example

Figure 19:
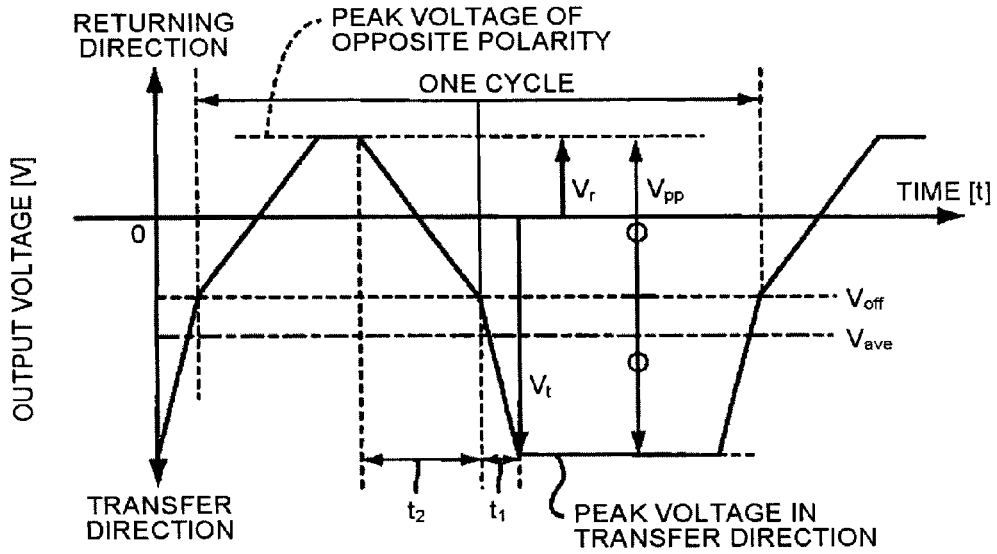
FIG. 19 is a schematic illustrating a voltage waveform of a secondary transfer bias output from a power supply according to a second example.

In the alternating current component, a gradient of a rise and a fall of the returning direction voltage is set smaller than a gradient of a rise and a fall of the transfer direction voltage. At this time, $t_2>t_1$ is satisfied in the waveform of the output voltage where $t_1$ is time in which the voltage transits from the transfer direction peak voltage to the median voltage $V_{off}$, and $t_2$ is time in which the voltage transits from the median voltage $V_{off}$ to the peak voltage at opposite polarity of the transfer direction voltage. The waveform at this time is illustrated in FIG. 19. The returning rate was set to 40%. The effects are illustrated in FIG. 28. In this manner, the time-averaged value $V_{ave}$ of the voltage can be set more in the transfer direction than the median voltage $V_{off}$ between the maximum voltage and the minimum voltage.

Third Example

Figure 20:
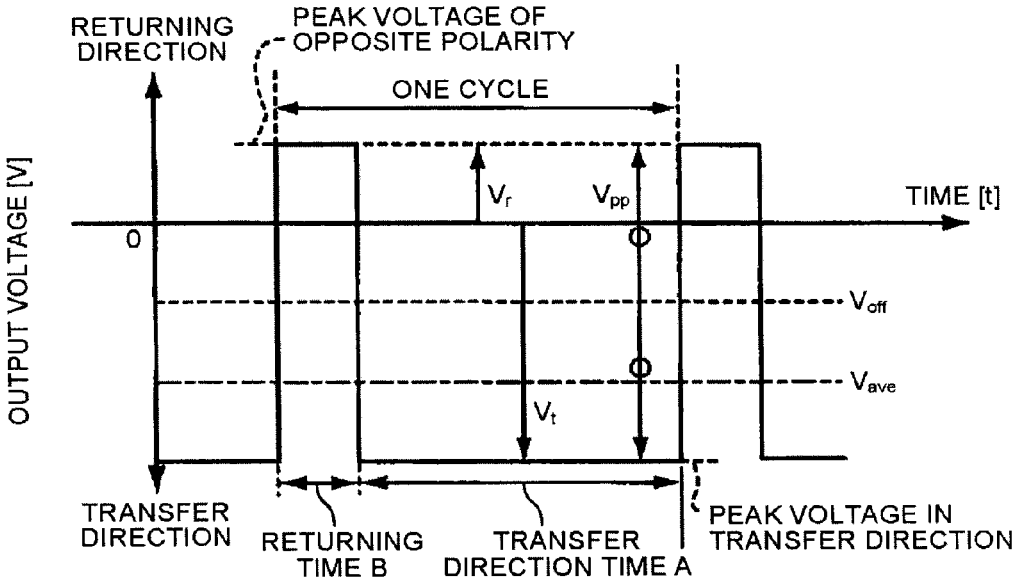
FIG. 20 is a schematic illustrating a voltage waveform of a secondary transfer bias output from a power supply according to a third example.

Another approach for making a waveform having a smaller area on the returning direction than that on the transfer direction with respect to the median voltage $V_{off}$ of the alternating current component is to make the returning time B shorter than the transfer direction time A, as illustrated in FIG. 20. In this manner, the returning time B can be made smaller than the transfer direction time A.

Fourth Example

Figure 21:
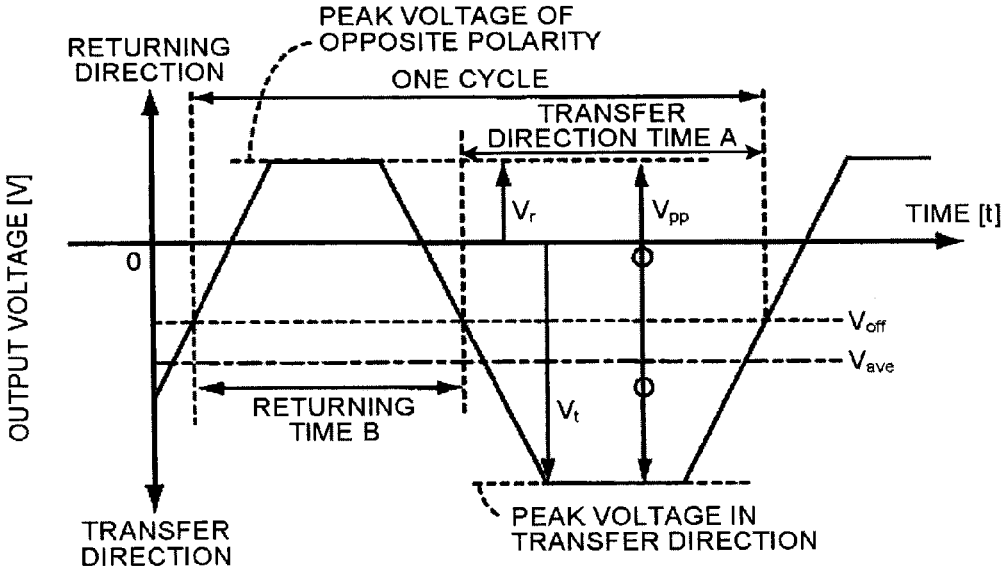
FIG. 21 is a schematic illustrating a voltage waveform of a secondary transfer bias output from a power supply according to a fourth example.

In the alternating current component, the returning time B was made shorter than the transfer direction time A. The waveform at this time is illustrated in FIG. 21. The returning time was set to 45%. The effects are illustrated in FIG. 29.

Fifth Example

Figure 22:
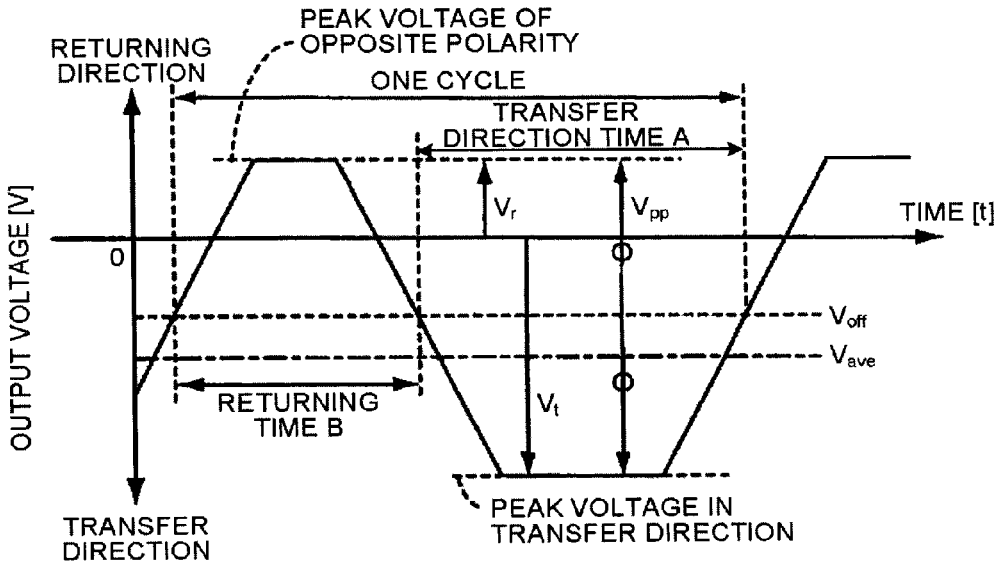
FIG. 22 is a schematic illustrating a voltage waveform of a secondary transfer bias output from a power supply according to a fifth example.

In the alternating current component, the returning time B was made shorter than the transfer direction time A. The waveform at this time is illustrated in FIG. 22. The returning time was set to 40%. The effects are illustrated in FIG. 30.

Sixth Example

Figure 23:
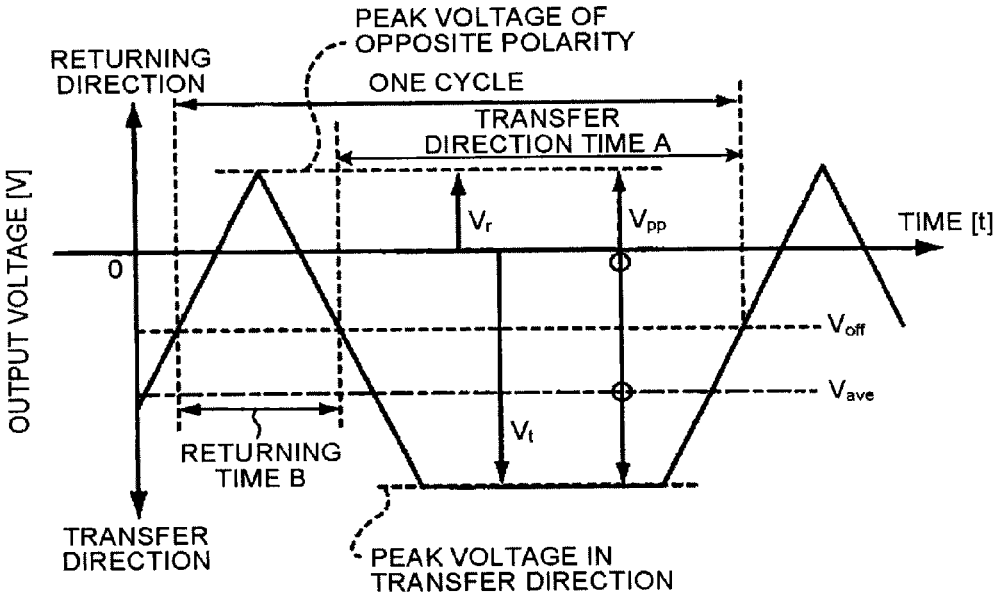
FIG. 23 is a schematic illustrating a voltage waveform of a secondary transfer bias output from a power supply according to a sixth example.

In the alternating current component, the returning time B was made shorter than the transfer direction time A. The waveform at this time is illustrated in FIG. 23. The returning time was set to 32%. The effects are illustrated in FIG. 31.

Seventh Example

Figure 24:
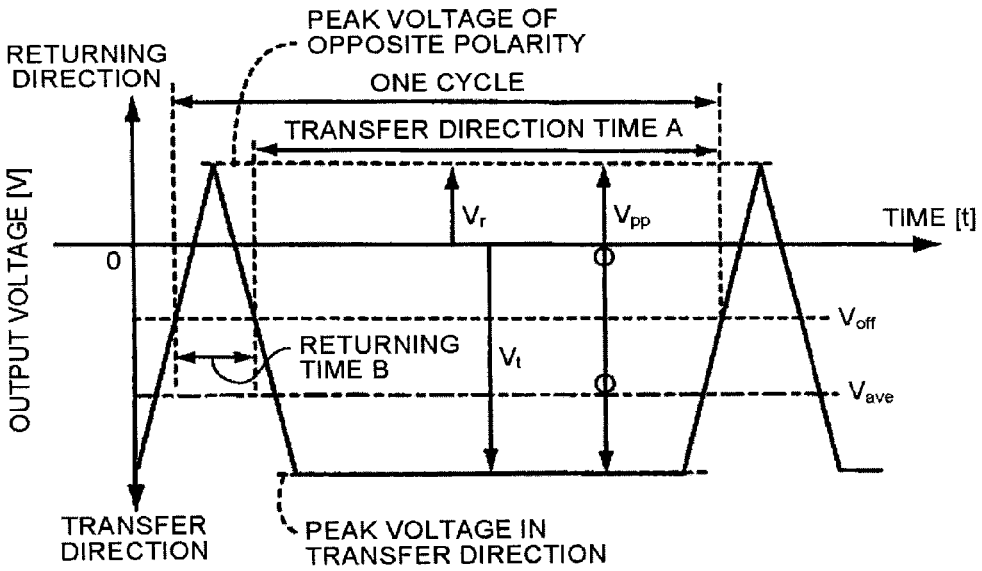
FIG. 24 is a schematic illustrating a voltage waveform of a secondary transfer bias output from a power supply according to a seventh example.

In the alternating current component, the returning time B was made shorter than the transfer direction time A. The waveform at this time is illustrated in FIG. 24. The returning time was set to 16%. The effects are illustrated in FIG. 32.

Eighth Example

Figure 25:
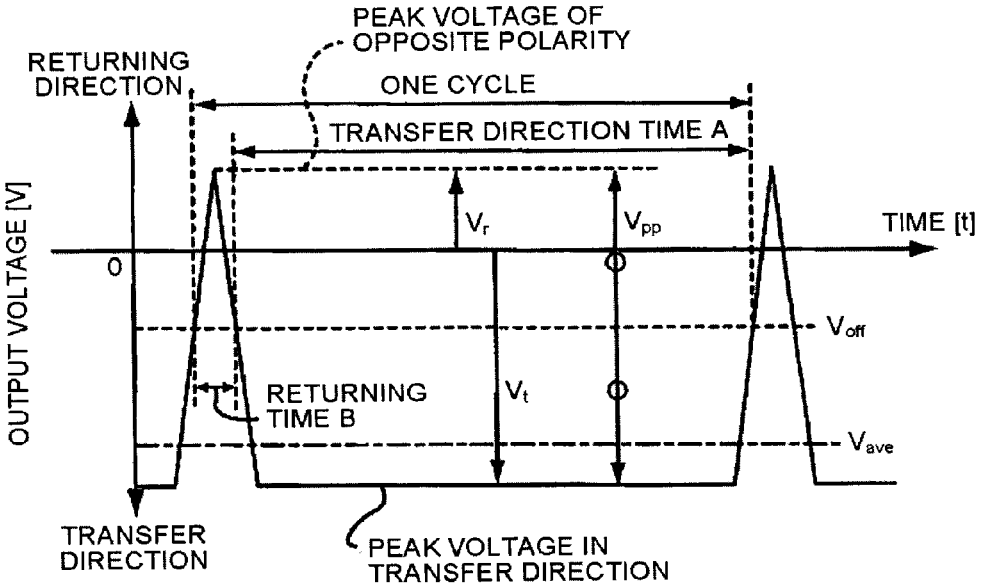
FIG. 25 is a schematic illustrating a voltage waveform of a secondary transfer bias output from a power supply according to an eighth example and a ninth example.

In the alternating current component, the returning time B was made shorter than the transfer direction time A. The waveform at this time is illustrated in FIG. 25. The returning time was set to 8%. The effects are illustrated in FIG. 33.

Ninth Example

In the alternating current component, the returning time B was made shorter than the transfer direction time A. Because the waveform at this time is the same as that illustrated in FIG. 25, a depiction of the waveform is omitted. The returning time was set to 4%. The effects are illustrated in FIG. 34.

Tenth Example

Figure 26:
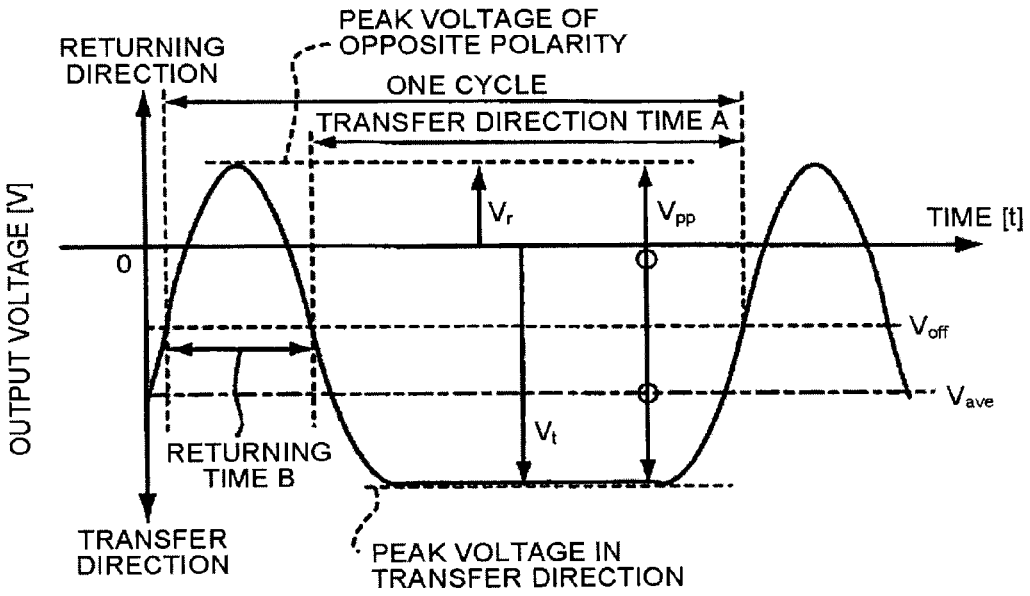
FIG. 26 is a schematic illustrating a voltage waveform of a secondary transfer bias output from a power supply according to a tenth example.

In the alternating current component, the returning time B was made shorter than the transfer direction time A, and the waveform is rounded. The waveform at this time is illustrated in FIG. 26. The returning time was set to 16%. The effects are illustrated in FIG. 35.

In FIG. 35, the peak-to-peak voltage $V_{pp}$=12 kilovolts, and the time-averaged value $V_{ave}$ of the voltage=−5.4 kilovolts, the median voltage $V_{off}$=−2.4 kilovolts.

Second Experiment

Figure 36:
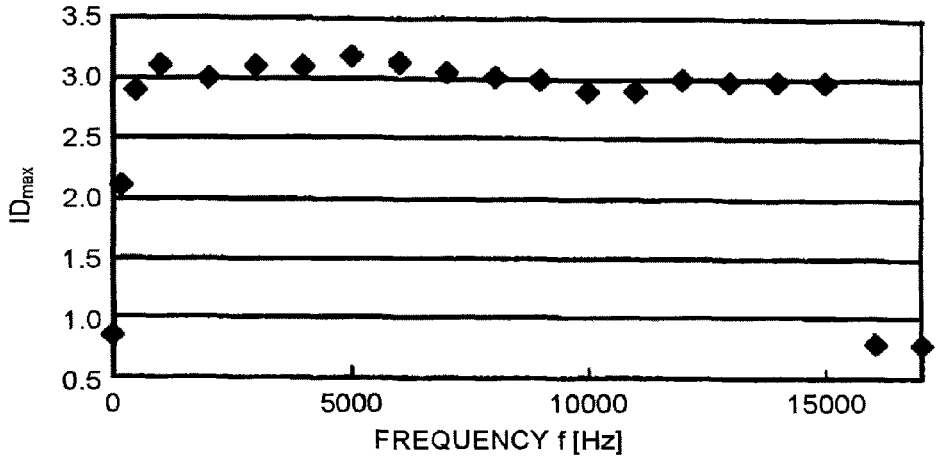
FIG. 36 is a graph illustrating a relationship between $ID_{max}$ and a frequency f of an alternating current component.

The inventors looked for the minimum rise time $t_1$ for allowing the toner entered into the recessed parts of the paper surface to be effectively returned to the belt in the secondary transfer nip N. Specifically, in the condition of returning time rate=50 [%], the frequency f of the alternating current component of the secondary transfer bias was changed as appropriate, and the image density of the solid blue image on the recessed parts was measured. The relationship between $ID_{max}$ of the recessed parts and the frequency f of the alternating current component obtained by the experiment is illustrated in FIG. 36.

Third Experiment

In the conditions of a peak-to-peak voltage of the alternating current component $V_{pp}$=2500 [volts], the offset voltage $V_{off}$ as the median voltage=−800 [volts], and a returning time rate=20 [%], a solid blue image was output to plain paper while changing the frequency f of the alternating current component and the process linear velocity v, under each of the conditions of the frequency f and the process linear velocity v. The output solid image was then visually observed. The presence of image density unevenness (pitch unevenness) that could be caused by the alternating current field in the secondary transfer nip N was then evaluated. When the process linear velocity v was increased while the condition of the frequency f was kept the same, pitch unevenness occurred more easily. When the frequency f was lowered while the condition of the process linear velocity v was kept the same, pitch unevenness occurred more easily.

These results suggest that pitch unevenness could occur unless the toner is reciprocated between the intermediate transfer belt and the recessed parts of the paper surface in the secondary transfer nip N for at least a certain number of times (hereinafter, referred to as an in-nip reciprocation count N).

Under the conditions of a process linear velocity v=282 [mm/s] and a frequency f=400 [hertz], no pitch unevenness was observed.

Under the conditions of a process linear velocity v=282 [mm/s] and a frequency f=300 [hertz], pitch unevenness was observed.

The width d of the secondary transfer nip N that is the length of the secondary transfer nip N in the moving direction of the belt was 3 millimeters. Therefore, the in-nip reciprocation count N under the conditions where no pitch unevenness was observed can be calculated as (3 [millimeters]×400 [hertz]/282 [mm/s])=approximately 4 times, and it is the minimum value for avoiding the pitch unevenness. In other words, this is the minimum in-nip reciprocation count.

Under the conditions of a process linear velocity v=141 [mm/s] and a frequency f=200 [hertz], no pitch unevenness was observed.

However, under the conditions of the process linear velocity v=141 [mm/s] and the frequency f=100 [hertz], pitch unevenness was observed. In the conditions of the process linear velocity v=141 [mm/s] and the frequency f=200 [Hz], in the same manner as the conditions of the process linear velocity v=282 [mm/s] and the frequency f=400 [hertz], the in-nip reciprocation count N can be calculated as (3 [millimeters]×200 [hertz]/141 [mm/s])=approximately 4 times. Therefore, it can be said that, by providing the minimum condition "frequency f>(4/d)×v", an image without pitch unevenness can be obtained.

Therefore, in the printer according to the embodiment, the power supply 39 for the secondary transfer is configured to output an alternating current component satisfying the relationship "f>(4/d)×v". To satisfy such a condition, the printer includes the operation panel 50 being an information obtaining unit, and a communicating unit, not illustrated, for obtaining printer driver setting information received from external via a communication, and recognizes which one of the high speed mode, the normal mode, and the low speed mode is to be used in performing a printing operation based on the information thus obtained. Based on the result of recognition, the control unit 60 recognizes the process linear velocity v. In other words, in the embodiment, different process linear velocities v corresponding to the high speed mode, the normal mode, and the low speed mode are stored in the control unit 60 in advance, and the control unit 60 recognizes the process linear velocity v when one of the modes is selected. In other words, the control unit 60 functions as a changing unit that changes a preset target output current of the direct current component based on the result of obtaining performed by the operation panel 50.

Fourth Experiment

In the secondary transfer nip N, the toner cannot be transferred well unless a transfer current at a certain level flows into the recording sheet P. Furthermore, naturally, it is harder for a transfer current to flow into thick paper than a recording sheet having a regular thickness. It is preferable for the toner to be attached to both of the projected parts and the recessed parts of the paper surface in both of washi having a regular thickness and washi having a larger thickness. The fourth experiment was conducted to examine advantageous controlling of the secondary transfer bias for achieving this goal.

As the power supply 39 for the secondary transfer, the inventors used a power supply that applies a constant voltage control to the peak-to-peak $V_{pp}$ and the offset voltage (median voltage) $V_{off}$ of the alternating current component and then outputs the alternating current component. Other various conditions were as follows.

process linear velocity v=282 [mm/s]

recording sheet: Leathac 66 175-kilogram paper test image: A4-sized solid black image returning time rate=40 [%]

offset voltage $V_{off}$: 800 [volts] to 1800 [volts]

peak-to-peak voltage $V_{pp}$: 3 [kilovolts] to 8 [kilovolts]

frequency f=500 [hertz]

Under these conditions, the inventors evaluated the image density of the solid black image output to the recessed parts of the paper surface in a manner described below.

rank 5: the recessed parts were completely filled with toner.

rank 4: the recessed parts were almost completely filled with toner, but the original paper surface was slightly shown in deeper portions of the recessed parts.

rank 3: the original paper surface was obviously shown in the deeper portions of the recessed parts.

rank 2: worse than the rank 3, but better than a rank 1 described below.

rank 1: toner was not attached to the recessed parts.

The inventors evaluated the image density of the solid black image on the projected parts of the paper surface in the manner described below.

rank 5: high image density without any density unevenness was achieved.

rank 4: slight density unevenness was observed, but image density without any problem was achieved even in a less dense parts.

rank 3: density unevenness was observed, and the image density in the less dense part was insufficient exceeding an acceptable level.

rank 2: worse than the rank 3 but better than a rank 1 described below.

rank 1: the image density was entirely insufficient.

The inventors summarized the image density evaluation results on the recessed parts and the image density evaluation result on the projected parts in the manner described below.

"●": image density evaluation results on both of the recessed parts and the projected parts were the rank 5 or higher.

"○": image density evaluation results on both of the recessed parts and the projected parts were the rank 4 or higher.

"□": image density evaluation results only on the recessed parts were the rank 3 or lower.

"Δ": image density evaluation results only on the projected parts were the rank 3 or lower.

"x": image density evaluation results on both of the recessed parts and the projected parts were the rank 3 or lower.

The inventors conducted the same experiments after replacing a recording sheet P from Leathac 66 175-kilogram paper sheets to Leathac 66 215-kilogram paper having a larger thickness. For combinations of the offset voltage (median voltage) $V_{off}$ and the peak-to-peak voltage $V_{pp}$, the inventors extracted combinations that achieved results of either "●" (the image density evaluation results of the rank 5 or higher on both of the recessed parts and on the projected parts) or "○" (the image density evaluation results of the rank 4 or higher on both of the recessed parts and on the projected parts) on both of Leathac 66 (175-kilogram paper) and Leathac 66 (215-kilogram paper), from all of the combinations used in the experiments. As a result, no combination could achieve the result of "●" on both types of paper. A combination that achieved a result of "○" on both types of paper was $V_{pp}$=6 [kilovolts] and an offset voltage $V_{off}$=−1100±100 [volts] (median ±9%).

Fifth Experiment

As the power supply 39 for the secondary transfer, the inventors used a power supply applying constant current control to each of the offset voltages (median voltages) $V_{off}$. The target output current (offset current $I_{off}$) was set to −30 microamperes to −60 microamperes. For the other conditions, the same conditions as those in the fourth experiment were used in conducting the experiment.

As image density evaluation results on both of the recessed parts and the projected parts, a combination of $V_{pp}$ and the offset current $I_{off}$ achieving a result of the rank 5 or higher (black circle) was $V_{pp}$=7 kilovolts and $I_{off}$=−42.5±7.5 [microamperes] (median ±18%). The combination achieving a result of the white circle on both types of paper was $V_{pp}$=7 kilovolts and an offset current $I_{off}$=−47.5±12.5 [microamperes] (median ±26%).

In the fourth experiment, as mentioned earlier, there was no combination that achieved the result of "●" on both types of paper. By contrast, in the fifth experiment, there was a combination that achieved the result of "●" on both types of paper. Furthermore, focusing on the combinations that achieved the result of "○", in the fourth experiment, an offset voltage $V_{off}$=−1100±100 [volts] (median ±9%). By contrast, in the fifth experiment, $V_{pp}$=7 kilovolts and an offset current $I_{off}$=−47.5±12.5 [microamperes] (median ±26%). Obviously, the range from the median in the latter is wider. These experiment results indicate that, when the constant current control is applied to the direct current component of the secondary transfer bias, a greater allowance can be ensured in a control target that can support thick paper as well as paper with a regular thickness, compared with when the constant voltage control is applied to the direct current component.

Therefore, used as the power supply 39 for the secondary transfer in the printer according to the embodiment is a power supply applying constant current control to the direct current component before outputting the direct current component. The power supply 39 for the secondary transfer is also configured to apply the constant current control to the peak-to-peak current before outputting the alternating current component. In this manner, regardless of environmental changes, the peak-to-peak current $I_{pp}$ can be kept constant, so that an effective returning peak current or sending peak current can be reliably generated.

Based on the results of these experiments, as a comparison between the first comparative example and the first embodiment indicates, when the time-averaged value $V_{ave}$ of the secondary transfer bias is more in the transfer direction than the median voltage $V_{off}$ that is a median between the maximum voltage and the minimum voltage of the secondary transfer bias, the effective ranges of the transferability onto a textured recording sheet were dramatically improved. Because the effective ranges are wider, sufficient image density can be achieved on both of the recessed parts and the projected parts of a recording medium surface even when various parameters such as types of paper sheets, image patterns, and usage environments are changed, and formation of white spots can be avoided. In this manner, high-quality images can be achieved.

The time-averaged value $V_{ave}$ being more in the transfer direction than the median voltage $V_{off}$ can be assumed to be effective because only the time-averaged value $V_{ave}$ can be increased without increasing the transfer direction peak voltage $V_t$, which could be a cause of discharge, while ensuring a necessary returning peak voltage $V_r$.

Based on the results of the first to the seventh embodiments, by making the returning time shorter than the transfer time, the returning time can be reduced further. Therefore, better images can be achieved. In other words, better images can be achieved by setting the output from the power supply 39 so that A>B is established where A is output time of voltages in the transfer direction side with respect to the median voltage $V_{off}$, and B is output time of voltages in the polarity opposite side with respect to the median voltage $V_{off}$.

Furthermore, based on the result of the eighth embodiment, when the returning time is excessively short (despite being wider than the sine wave), the effective ranges are reduced as well. Therefore, it is desirable to set the output from the power supply 39 so that 0.10<X<0.40 is satisfied where the voltage of the secondary transfer bias is X and the range of X is X=B/(A+B).

Based on FIG. 36 indicating the result of the second experiment, the image density (ID) of the recessed parts suddenly drops when the frequency exceeds 15000 Hz. It can be assumed that, because the returning-time is too short, the toner did not reciprocate. Because the returning time period in one cycle at the frequency 15000 Hz is 0.033 msec, it is preferable to set the output of the power supply 39 so that the time during which the voltage at the opposite polarity of the transfer direction voltage is applied is at least 0.03 msec or longer in the secondary transfer bias.

When an alternating current (AC) transfer voltage is applied to the secondary transfer nip N (secondary transfer unit) as the secondary transfer bias, the controlled voltage is applied to the core metal of the secondary transfer rear surface roller 33, for example. However, in practice, because an object of voltage application is to generate a potential difference in the secondary transfer nip N, simply by controlling the potential of the core metal of the secondary transfer rear surface roller 33, the desired potential difference will not be generated in the secondary transfer nip N (secondary transfer unit) when the resistance of the resistance layer (resin part made of rubber or sponge, for example) of the secondary transfer rear surface roller 33 is changed.

In response to this issue, a constant current is supplied to the secondary transfer nip N without a recording sheet P (or possibly with a recording sheet), and the resistance of the secondary transfer nip N (the secondary transfer rear surface roller 33, the intermediate transfer belt 31, the nip forming roller 36) is measured based on a voltage required. An AC transfer voltage based on the measurement is then applied. In this manner, a potential difference near a desired level can always be obtained in the secondary transfer nip N (secondary transfer unit).

To obtain a voltage to be applied to the secondary transfer nip N based on the resistance thus measured, the voltage to be applied may be obtained directly from the resistance of the secondary transfer nip N, or the resistance may be classified into a table divided by some thresholds, and the voltage may be obtained for each table.

Explained below is an example of a method for correcting the voltage to be applied when the resistance of the secondary transfer nip N and the like are changed. In this example, the constant current control is applied to the direct current component, and the constant voltage control is applied to the alternating current component. However, the present invention is not limited thereto. The constant current control and the constant voltage control may be applied to both of the direct current component and the alternating current component. In such a case as well, the electric field to be applied can be obtained from the resistance of the secondary transfer nip N with different values of the correction coefficients.

Regardless of the combination of controls, the direct current component and the alternating current component have to be corrected separately. This is because while most of the applied current of the direct current component flows from the secondary transfer rear surface roller 33 into the recording sheet P and into the nip forming roller 36, most of the current of the alternating current component is consumed in charging the secondary transfer rear surface roller 33 or the nip forming roller 36, and only part of the applied current flows from the secondary transfer rear surface roller 33 into the recording sheet P and into the nip forming roller 36, because the polarity is quickly switched in the alternating current component. Specifically, while the current level of the direct current component applied in this configuration is −10 microamperes to −100 microamperes, an alternating current component at the level of ±0.5 milliamperes to ±10 milliamperes is applied.

As an example of the correction method, in Table 1 below, five thresholds are assigned to the resistance to create a table divided into six rows, and R−2 to R+3, R0 being at a standard, are set in the ascending order of the resistance, and a degree of resistance correction is determined for each. There is an opposite tendency in an increase and a decrease of the coefficients between the direct current component and the alternating current component. This is because of the difference between the constant voltage control and the constant current control explained earlier.

In the constant current control, because the current passing through the secondary transfer nip N is controlled, when the resistance of the secondary transfer rear surface roller 33 decreases, the potential difference generated in the secondary transfer nip N is reduced as well. Therefore, the potential difference generated in the transfer nip N will not be constant unless the controlled current is increased. By contrast, in the constant voltage control, because the voltage at the core metal in the secondary transfer rear surface roller 33 is controlled, the voltage is reduced by the rubber layer of the secondary transfer rear surface roller 33 before the potential difference is formed in the secondary transfer nip N. Therefore, when the resistance of the secondary transfer rear surface roller 33 decreases, the potential difference generated in the secondary transfer nip N increases. Hence, the potential difference generated in the secondary transfer nip N will not be constant unless the controlled voltage is decreased.

TABLE 1

Resistance Correction Coefficients

| Name | | Coefficients for Alternating | Coefficients for Direct |
|---|---|---|---|
| Subclassification | Sub-Subclassification | Current Component | Current Component |
| Secondary Transfer: Resistance Correction Coefficients | R-2 | 81% | 117% |
| Secondary Transfer: Resistance Correction Coefficients | R-1 | 90% | 112% |
| Secondary Transfer: Resistance Correction Coefficients | R0 | 100% | 108% |
| Secondary Transfer: Resistance Correction Coefficients | R + 1 | 115% | 105% |

TABLE 1-continued

| Resistance Correction Coefficients | | | |
|---|---|---|---|
| Name | | Coefficients for Alternating | Coefficients for Direct |
| Subclassification | Sub-Subclassification | Current Component | Current Component |
| Secondary Transfer: Resistance Correction Coefficients | R + 2 | 120% | 103% |
| Secondary Transfer: Resistance Correction Coefficients | R + 3 | 260% | 102% |

By using the correction coefficients provided in Table 1, the same transferability can be achieved even when the resistance of the secondary transfer nip N is changed. The correction coefficients provided in Table 1 are merely examples used in the embodiment, and these correction coefficients vary when the system is changed.

The electric field to be applied to the secondary transfer rear surface roller 33 will also be different depending on the moisture contained in the recording sheet P. This is because the electrical resistance of the recording sheet P decreases when the moisture in the recording sheet P increases. When the electrical resistance of the recording sheet P decreases, the potential difference to be generated in the secondary transfer nip N is reduced.

For example, in Table 2, the temperature and the humidity in the image forming apparatus are measured, five thresholds are set for the absolute humidity obtained from the measurements. The table is then divided into six rows using these threshold. LLL, LL, ML, MM, MH, and HH are set in the ascending order of the absolute humidity, and a degree of correcting the temperature and the humidity environments is determined for each. Because the temperature and humidity environment coefficients are intended to correct variations due to the resistance of the paper in the transfer nip N, the tendency of coefficient increases and decreases is the same between the constant voltage control and the constant current control.

TABLE 2

| Humidity Environment Correction Coefficients | | | |
|---|---|---|---|
| Name | | Coefficients for Alternating | Coefficients for Direct |
| Subclassification | Sub-Subclassification | Current Component | Current Component |
| Secondary Transfer: Environment Correction Coefficients | LLL | 127% | 105% |
| Secondary Transfer: Environment Correction Coefficients | LL | 121% | 105% |
| Secondary Transfer: Environment Correction Coefficients | ML | 113% | 100% |
| Secondary Transfer: Environment Correction Coefficients | MM | 100% | 100% |

TABLE 2-continued

| Humidity Environment Correction Coefficients | | | |
|---|---|---|---|
| Name | | Coefficients for Alternating | Coefficients for Direct |
| Subclassification | Sub-Subclassification | Current Component | Current Component |
| Secondary Transfer: Environment Correction Coefficients | MH | 80% | 90% |
| Secondary Transfer: Environment Correction Coefficients | HH | 60% | 85% |

As explained above, by controlling the electrical field applied to the secondary transfer rear surface roller 33, constant transferability can be achieved even when a cause of errors changes.

However, when a simpler voltage applying unit is used, the voltage waveform could be blunted.

Furthermore, the voltage waveform could change when the electrical capacity of the secondary transfer nip N is changed. For example, when the electrical capacity is small, the electric charge once applied might leak and cause a voltage to drop. Considering these issues, voltage waveforms are obtained assuming both of a high capacity and a low capacity of the secondary transfer nip N using a power supply with a low maximum output current. A function generator is then used to generate the waveforms in the same manner as in the other embodiments. The waveforms were then amplified before being applied to the secondary transfer rear surface roller 533 illustrated in FIG. 10.

Eleventh Example

Figure 37:
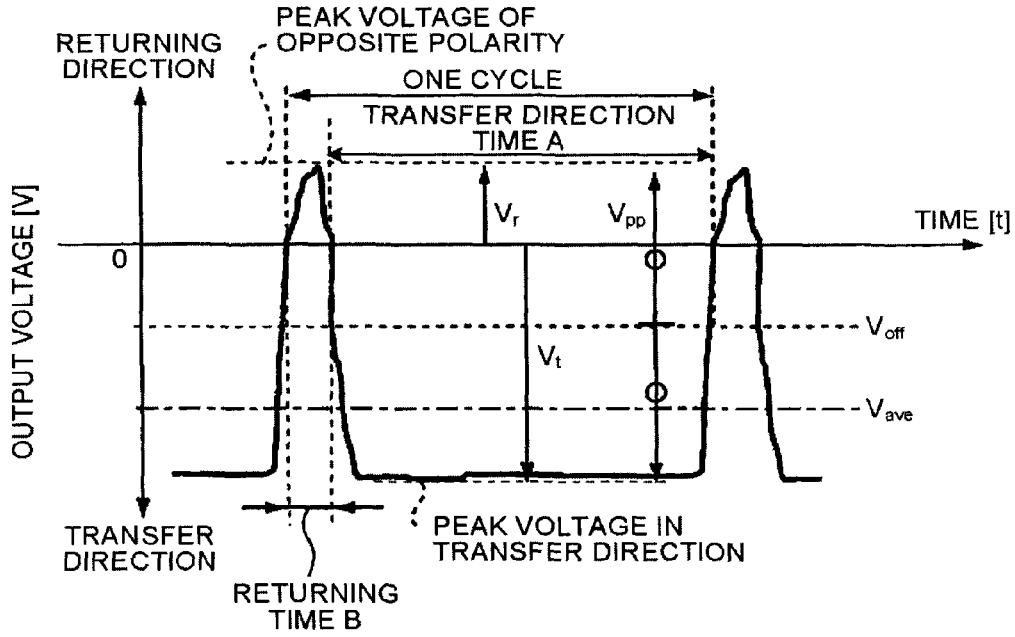
FIG. 37 is a schematic illustrating a voltage waveform of a secondary transfer bias output from a power supply according to an eleventh example.

The electrostatic capacity of the secondary transfer nip N was assumed to be 170 picofarads, and the resistance was assumed to be 17 megaohms. The waveform in this example is illustrated in FIG. 37. At this time, the returning rate was 12%. The effects are illustrated in FIG. 38.

Twelfth Example

Figure 39:
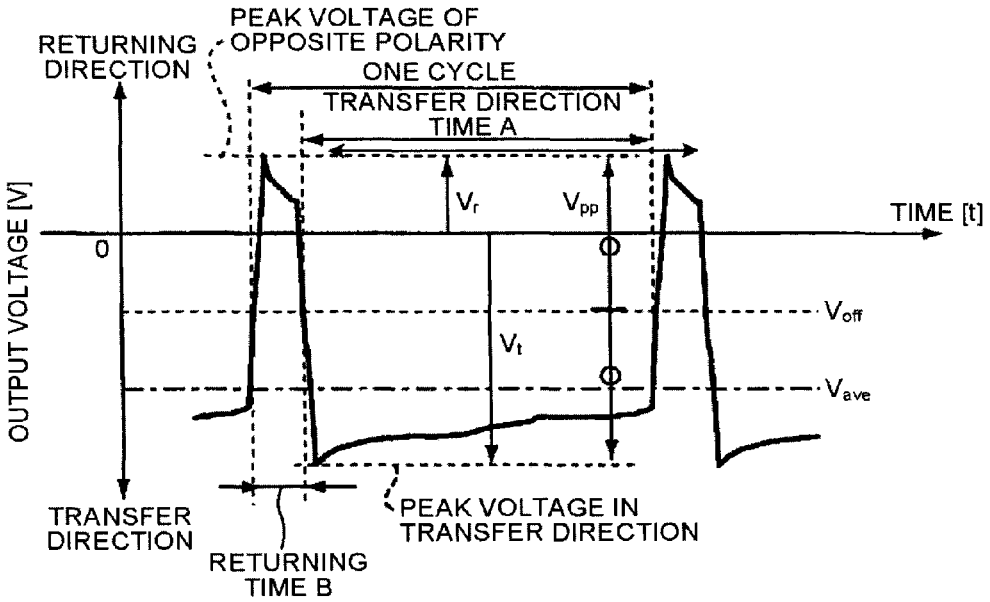
FIG. 39 is a schematic illustrating a voltage waveform of a secondary transfer bias output from a power supply according to a twelfth example.

The electrostatic capacity of the secondary transfer nip N was assumed to be 120 picofarads, and the resistance was assumed to be 15 megaohms. The waveform in this example is illustrated in FIG. 38. At this time, the returning rate was 12%. The effects are illustrated in FIG. 39.

Based on the results of the eleventh and the twelfth embodiments, even when the conditions of the secondary transfer nip N are changed, by making the returning time shorter than the transfer time, better images can be achieved than that in the comparative example. In FIG. 39, although the returning rate was set to 12%, the effective ranges were slightly narrower than those in the seventh embodiment where the returning rate was set to 16%. A cause of this could be a voltage drop, but the effects are still far better than those in the comparative example.

The resistance of the intermediate transfer belt 31, the secondary transfer rear surface roller 33, and the secondary transfer roller 36 and the thickness of the belt illustrated in FIG. 1 will now be explained.

Resistance

The secondary transfer rear surface roller 33: 6.0 Log Ω to 8.0 Log Ω, and preferably 7.0 Log Ω to 8.0 Log Ω

The secondary transfer roller 36: 6.0 Log Ω to 12.0 Log Ω (or SUS), and preferably 4.0 Log Ω

The surface resistance of the intermediate transfer belt 31: 9.0 Log Ω to 13.0 Log Ω, and preferably 10.0 Log Ω·cm to 12.0 Log Ω·cm The volume resistance of the intermediate transfer belt 31: 6.0 Log Ω·cm to 13 Log Ω·cm, preferably 7.5 Log Ω·cm to 12.5 Log Ω·cm, and more preferably approximately 9 Log Ω·cm Thickness of the intermediate transfer belt 31

20 to 200 micrometers, and preferably approximately 60 micrometers

Measurement Method

<Measurement of the Volume Resistance of the Secondary Transfer Roller 36>

Rotating Measurement

Load: 5 N/one side, Bias application: while applying (1 kilovolt) to the transfer roller axis, the resistance is measured for a single rotation of the transfer roller for one minute, and the average is used as the volume resistance.

<Measurement of Resistance, the Belt Surface Resistivity>

Hiresta HRS probe (manufactured by Mitsubishi Chemical Corporation) 500 volts, 10-second value <Measurement of Resistance, the Belt Volume Resistivity>

Hiresta HRS probe (manufactured by Mitsubishi Chemical Corporation) 100 volts, 10-second value The configuration of the transfer unit is not limited to the one illustrated in FIG. 1, and may be those explained below.

Figure 41:
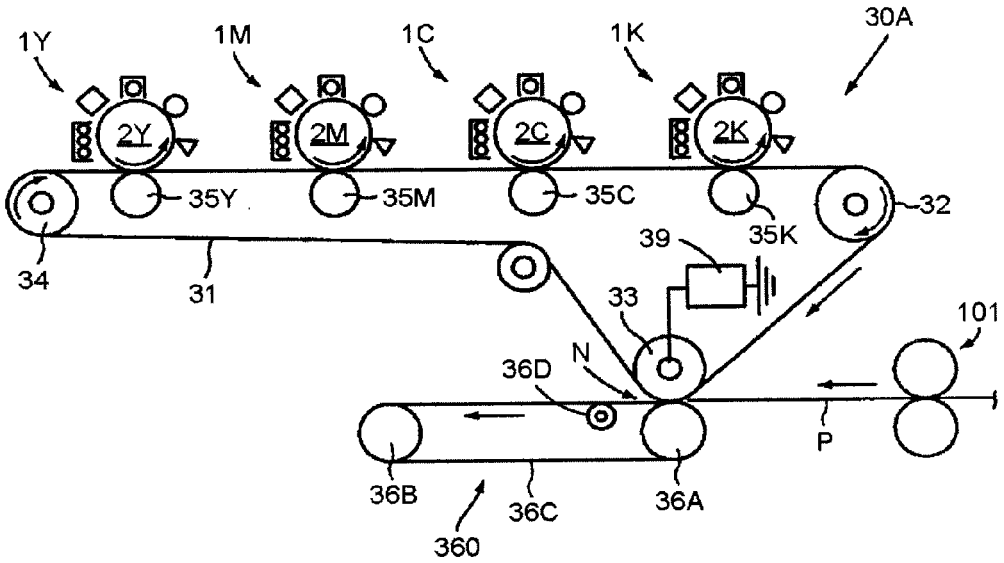
FIG. 41 is an enlarged view illustrating still another configuration of the power supply and the voltage supply for secondary transfer used in the image forming apparatus.

In a transfer unit 30A illustrated in FIG. 41, a secondary transfer conveying belt 36C is arranged, as a transfer member, facing the secondary transfer rear surface roller 33 arranged inside of the loop of the intermediate transfer belt 31, which is the image carrier arranged facing the image forming units 1Y, 1M, 1C, 1K. In this configuration, the moving direction of the intermediate transfer belt 31 is reversed from that in the configuration illustrated in FIG. 1.

The secondary transfer conveying belt 36C is wound around a driving roller 36A and a driven roller 36B, thereby forming a secondary transfer conveying unit 360. The intermediate transfer belt 31 and the secondary transfer conveying belt 36C abut against each other at a position where the secondary transfer rear surface roller 33 and the driving roller 36A face each other, thereby forming the secondary transfer nip N. The secondary transfer conveying belt 36C receives and conveys the recording sheet P fed into the secondary transfer nip N by the registration roller pair 101.

In the present embodiment, the driving roller 36A is grounded. By contrast, the secondary transfer rear surface roller 33 is applied with the secondary transfer bias from the power supply 39 supplying the secondary transfer bias. By the secondary transfer bias supplied from the power supply 39, a transfer field is formed in the secondary transfer nip N for electrostatically moving the toner image having been transferred onto the intermediate transfer belt 31 from the intermediate transfer belt 31 onto the secondary transfer belt 36C is formed in the secondary transfer nip N. The toner image on the intermediate transfer belt 31 is transferred onto the recording sheet P entered into the secondary transfer nip N by the effects of the secondary transfer field and the nipping pressure.

As a configuration for the bias application, instead of applying the bias to the secondary transfer rear surface roller 33, the secondary transfer rear surface roller 33 may be grounded, and a bias supplying roller 36D may be arranged inside of the loop of the secondary transfer belt 36C in a manner abutting against the secondary transfer belt 36C, as a configuration of a secondary transfer conveying unit 360. A bias supplying roller 36D and the power supply 39 may then be connected, so that the secondary transfer bias can be applied to the bias supplying roller 36D.

Figure 42:
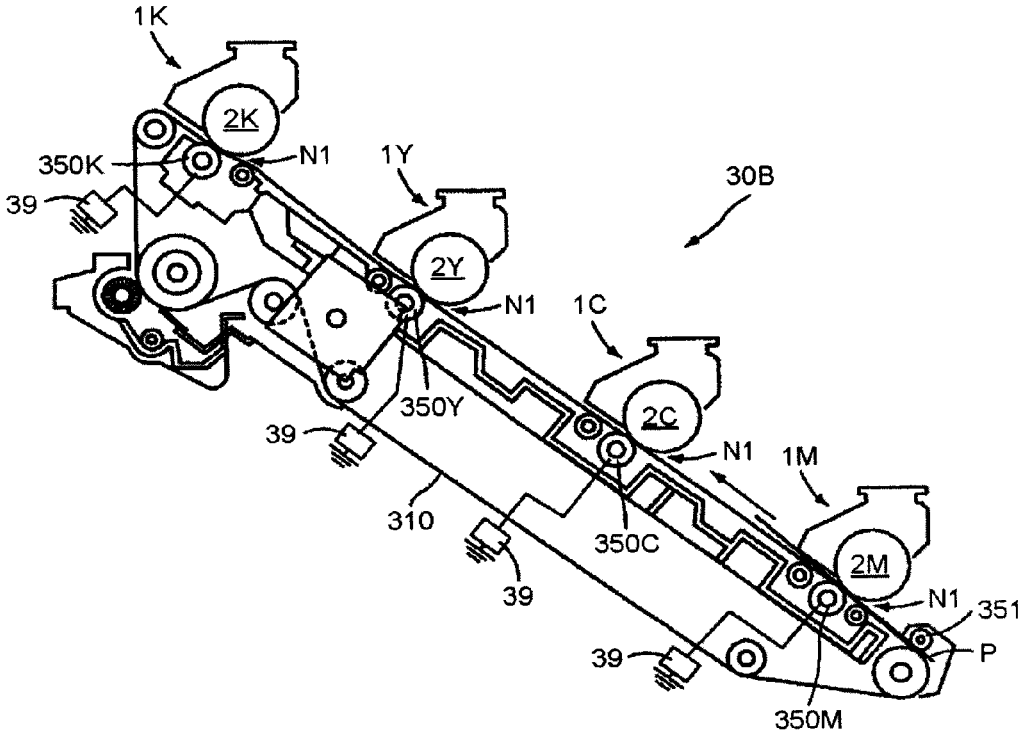
FIG. 42 is an enlarged view illustrating another configuration of the power supply and the voltage supply for transfer used in the image forming apparatus.

A transfer unit 30B illustrated in FIG. 42 includes a transfer conveying belt 310 as a transfer member arranged facing the image forming units 1M, 1C, 1Y, 1K, and wound around a plurality of roller members. The transfer conveying belt 310 to which the recording sheet P fed by registration rollers (not illustrated) adheres is configured to convey the recording sheet P into transfer nips N1, which are described later, and to be moved in rotation in the counterclockwise direction in FIG. 42. Transfer rollers 350M, 350C, 350Y, 350K to which the transfer bias is supplied from the respective power supplies 39 are arranged inside of the loop of the transfer conveying belt 310 in a manner facing the respective photosensitive elements 2M, 2C, 2Y, 2K for each of the colors. Each of the transfer rollers 350M, 350C, 350Y, 350K brings the transfer conveying belt 310 into contact with the corresponding photosensitive element in each of the colors. In this configuration, the transfer nips N1 are formed as abutting portions between the photosensitive elements 2M, 2C, 2Y, 2K and the transfer conveying belt 310.

In this configuration, while each of the photosensitive elements is grounded, the transfer rollers 350M, 350C, 350Y, 350K are applied with the transfer bias by the respective power supplies 39. In this manner, a transfer field is formed in each of the transfer nips N1 for electrostatically moving the toner image from each of the photosensitive elements 2M, 2C, 2Y, 2K onto the corresponding transfer roller.

The recording sheet P is conveyed from the lower right side in FIG. 42, is passed between a paper adhesive roller 351 applied with the bias and the transfer conveying belt 310, adheres to the transfer conveying belt 310, and then is conveyed into the transfer nip N1 for each of the colors. The toner image in each of the colors on the corresponding photosensitive element is sequentially transferred onto the recording sheet P that is conveyed into each of the transfer nips N1, by the effects of the transfer field and the nipping pressure, and a full-color toner image is formed on the recording sheet P.

In this configuration, the individual power supplies 39 are used to supply the transfer bias to the respective transfer rollers 350M, 350C, 350Y, 350K. However, the transfer bias may also be distributed from a single power supply 39 to the transfer rollers 350M, 350C, 350Y, 350K.

Figure 43:
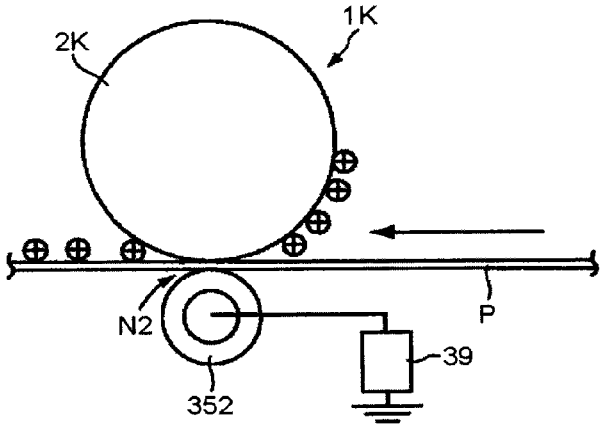
FIG. 43 is an enlarged view illustrating still another configuration of the power supply and the voltage supply for transfer used in the image forming apparatus.

The configuration is explained under the assumption that the image forming apparatus is an apparatus that forms a full-color image. However, the present invention is not limited to an image forming apparatus for forming a full-color image, and may also be applied to a monochromatic image forming apparatus in which a transfer roller 352 as a transfer member is arranged facing a black photosensitive element 2K included in a black image forming unit 1K, as illustrated in FIG. 43.

The transfer roller 352 includes a core metal made of stainless steel, aluminum, or the like, and a resistance layer made of conductive sponge laid over the core metal. A surface layer made of fluorine resin or the like, may be laid over the resistance layer.

In this configuration, the transfer roller 352 and the photosensitive element 2K abut against each other, and a transfer nip N is formed between these elements. While the photosensitive element 2K is grounded, the transfer roller 352 is applied with the transfer bias by the power supply 39. In this manner, a transfer field is formed between the transfer roller 352 and the photosensitive element 2K for electrostatically moving the toner image having been formed on the photosensitive element 2K from the photosensitive element 2K onto the transfer roller 352. The toner image on the photosensitive element 2 is transferred onto the recording sheet P fed into the transfer nip N2 by the effects of the transfer field and the nipping pressure.

Figure 44:
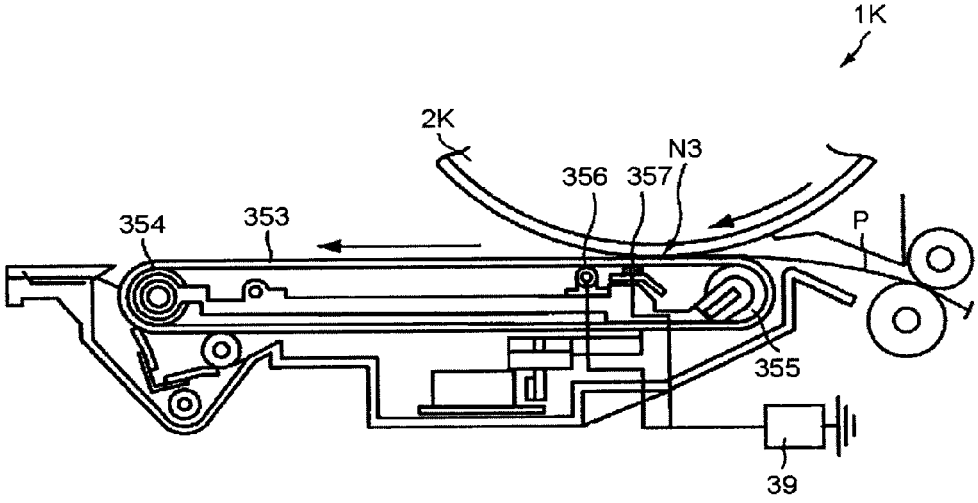
FIG. 44 is an enlarged view illustrating still another configuration of the power supply and the voltage supply for transfer used in the image forming apparatus.

A configuration illustrated in FIG. 44 uses a transfer conveying belt 353, as a transfer member, arranged facing and in contact with the single photosensitive element 2K. The transfer conveying belt 353 is wound around and supported by a driving roller 354 and a driven roller 355, and is configured to be moved by the driving roller 354 in the direction indicated by the arrow in FIG. 44. The photosensitive element 2K and a part of the transfer conveying belt 353 abut against each other at a position between the driving roller 354 and the driven roller 355, thereby forming a transfer nip N3 is thus formed. The transfer conveying belt 353 receives and conveys the recording sheet P fed into the transfer nip N3.

Inside of the loop of the transfer conveying belt 353, a transfer bias roller 356 and a bias brush 357 are arranged. The transfer bias roller 356 and the bias brush 357 are arranged abutting against the inner surface of the transfer conveying belt 353 at a position downstream of the transfer nip N3 in the moving direction of the belt.

In this configuration, while the photosensitive element 2K is grounded, the transfer bias roller 356 and the bias brush 357 are applied with the transfer bias by the power supply 39. In this manner, a transfer field is formed in the transfer nip N3 for electrostatically moving the toner image from the photosensitive element 2K onto the transfer conveying belt 353. The toner image on the photosensitive element 2K is conveyed by the transfer conveying belt 353, and transferred onto the recording sheet P entered into the transfer nip N3, by the effects of the transfer field and the nipping pressure.

In this configuration, both of the transfer bias roller 356 and the bias brush 357 are provided, and arranged in contact with the transfer conveying belt 353. The transfer bias roller 356 and the bias brush 357 are not necessarily required in pair, only one of the transfer bias roller 356 and the bias brush 357 may be provided. Furthermore, the transfer bias roller 356 or the bias brush 357 may be arranged directly under the transfer nip N3.

In the manner described above, in the configurations illustrated in FIGS. 41 to 44, by making the time-averaged value $V_{ave}$ of the secondary transfer bias or the transfer bias as a voltage more in the transfer direction than the median voltage $V_{off}$, which is a median between the maximum voltage and the minimum voltage of the secondary transfer bias (transfer bias), using the control unit 60 in the image forming apparatus, the effective ranges of the transferability onto a textured recording sheet P are dramatically improved. As a result, sufficient image density can be achieved on both of the recessed parts and the projected parts of a recording medium surface even when various parameters such as types of paper sheets, image patterns, and usage environments are changed, and formation of white spots can be avoided. In this manner, high-quality images can be achieved.

EXPLANATIONS OF LETTERS OR NUMERALS

2(Y,M,C,K), 31, 353 Image carrier
36, 36C, 310, 352, 353 Transfer member
39 Power supply
50 Information obtaining unit
60 Changing unit
P Recording medium
N, N(1-3) Transfer nip
X Voltage
$V_{ave}$ Time-averaged value of voltage
$V_{off}$ Median between maximum and minimum of voltage

PRIOR ART DOCUMENTS

Patent Literatures

[Patent Literature 1] Japanese Patent Application Laid-open No. 2006-267486

The invention claimed is:

1. An image forming apparatus comprising:

a transfer member configured to abut against an image carrier for carrying a toner image to form a transfer nip; and a power supply configured to output a bias voltage for transferring the toner image on the image carrier onto a recording medium nipped in the transfer nip, wherein the bias voltage includes a first voltage for transferring the toner image from the image carrier onto the recording medium in a transfer direction and a second voltage having an opposite polarity of the first voltage, the first voltage and the second voltage being alternately output when the toner image on the image carrier is transferred onto the recording medium, and a time-averaged value of the bias voltage is set to a polarity in the transfer direction and is set in a transfer direction side with respect to a median between a maximum and a minimum of the bias voltage.

2. The image forming apparatus according to claim 1, wherein the bias voltage is set to satisfy A>B, where A is output time of voltages in the transfer direction side with respect to the median, and B is output time of voltages in an opposite polarity side with respect to the median.

3. The image forming apparatus according to claim 2, wherein the bias voltage is set to satisfy $0.05<X<0.45$, where $X=B/(A+B)$.

4. The image forming apparatus according to claim 3, wherein the bias voltage is set to satisfy $0.10<X<0.40$, where $X=B/(A+B)$.

5. The image forming apparatus according to claim 2, wherein the power supply outputs the bias voltage so that the second voltage is applied for a time equal to or longer than 0.03 msec.

6. The image forming apparatus according to claim 2, wherein the power supply outputs the bias voltage so that $f>(4/d)\times v$ is satisfied, where f is a frequency [hertz], d is a nip width [millimeters] that is a length of the transfer nip in a moving direction of a surface of the image carrier, and v is a moving velocity [mm/s] of the surface of the image carrier.

7. The image forming apparatus according to claim 6, further comprising:

an information obtaining unit configured to obtain information of a moving velocity of the surface of the image carrier; and a changing unit configured to change a preset target for an output current of a direct current component based on the information obtained by the information obtaining unit.

8. The image forming apparatus according to claim 2, wherein the power supply outputs a direct current component and an alternating current component superimposed over the direct current component as the bias voltage, and performs constant current control that keeps the direct current component constant.

9. The image forming apparatus according to claim 8, wherein the power supply performs constant current control that keeps a peak-to-peak current from a maximum to a minimum of the alternating current component constant.

10. The image forming apparatus according to claim 2, wherein the bias voltage transits from the first voltage to the second voltage in a predetermined period of time.

11. The image forming apparatus according to claim 1, wherein the bias voltage is set to satisfy $t_2>t_1$, where $t_1$ is time between a peak in the transfer direction side and the median, and $t_2$ is time between the median and a peak in an opposite polarity side.

12. The image forming apparatus according to claim 1, wherein the bias voltage transits from the first voltage to the second voltage in a predetermined period of time.

13. The image forming apparatus according to claim 1, wherein the bias voltage transits from the second voltage to the first voltage in a predetermined period of time.

14. An image forming method comprising:

alternately outputting a first voltage and a second voltage from a power supply to transfer a toner image on an image carrier onto a recording medium nipped in a transfer nip when the toner image on the image carrier is transferred onto the recording medium, the transfer nip being formed by a transfer member configured to abut against the image carrier for carrying the toner image, wherein the first voltage is for transferring the toner image from the image carrier onto the recording medium in a transfer direction, the second voltage has an opposite polarity of the first voltage, and a time-averaged value of voltages that include the first voltage and the second voltage is set to a polarity in the transfer direction and is set in a transfer direction side with respect to a median between a maximum and a minimum of the voltages.

15. The image forming method according to claim 14, wherein the voltages are set to satisfy A>B, where A is output time of voltages in the transfer direction side with respect to the median, and B is output time of voltages in an opposite polarity side with respect to the median.

16. The image forming method according to claim 14, wherein the voltages are set to satisfy $t_2>t_1$, where $t_1$ is time between a peak in the transfer direction side and the median, and $t_2$ is time between the median and a peak in an opposite polarity side.

17. The image forming method according to claim 14, wherein the first voltage transits to the second voltage in a predetermined period of time.

18. The image forming method according to claim 14, wherein the second voltage transits to the first voltage in a predetermined period of time.

19. An image forming apparatus comprising:

a transfer member configured to abut against an image carrier for carrying a toner image to form a transfer nip; and a power supply configured to output any one of a direct current bias voltage and a superimposed bias voltage for transferring the toner image on the image carrier onto a recording medium nipped in the transfer nip, wherein the superimposed bias voltage includes a first voltage for transferring the toner image from the image carrier onto the recording medium in a transfer direction and a second voltage having an opposite polarity of the first voltage, the first voltage and the second voltage being alternately output when the toner image on the image carrier is transferred onto the recording medium, and a time-averaged value of the bias voltage is set to a polarity in the transfer direction and is set in a transfer direction side with respect to a median between a maximum and a minimum of the bias voltage, and a voltage output from the power supply is switched between the direct current bias voltage and the superimposed bias voltage based on a type of the recording medium.

20. The image forming apparatus according to claim 19, wherein the voltage output from the power supply is switched between the direct current bias voltage and the superimposed bias voltage based on a degree of texture on a surface of the recording medium.

21. An image forming apparatus comprising:

an image configured to carry a toner image;

a transfer member configured to form a transfer nip between the image carrier and the transfer member; and a power supply configured to output any one of a direct current bias voltage and a superimposed bias voltage for transferring the toner image on the image carrier onto a recording medium nipped in the transfer nip, wherein the superimposed bias voltage includes a first peak voltage having a polarity to move the toner image from the image carrier onto the recording medium in the transfer nip and a second peak voltage having an opposite polarity of the first peak voltage, the first peak voltage and the second peak voltage being alternately output when the toner image on the image carrier is transferred onto the recording medium, and the superimposed bias voltage is set to satisfy A>B, where A is a time period in which the power supply outputs a voltage on a first peak voltage side with respect to a median between the first peak voltage and the second peak voltage in one cycle, and B is a time period in which the power supply outputs a voltage on a second peak voltage side with respect to the median in one cycle.

22. The image forming apparatus according to claim 21, wherein a voltage output from the power supply is switched between the direct current bias voltage and the superimposed bias voltage based on a type of the recording medium.

23. The image forming apparatus according to claim 21, wherein the superimposed bias voltage is set to satisfy $0.05<X<0.45$, where $X=B/(A+B)$.

24. The image forming apparatus according to claim 23, wherein the superimposed bias voltage is set to satisfy $0.08\leq X<0.45$, where $X=B/(A+B)$.

25. The image forming apparatus according to claim 24, wherein the superimposed bias voltage is set to satisfy $0.16\leq X<0.45$, where $X=B/(A+B)$.

26. The image forming apparatus according to claim 23, wherein the superimposed bias voltage is set to satisfy $0.05<X\leq 0.40$, where $X=B/(A+B)$.

27. The image forming apparatus according to claim 26, wherein the superimposed bias voltage is set to satisfy $0.05<X\leq 0.32$, where $X=B/(A+B)$.

28. The image forming apparatus according to claim 23, wherein the superimposed bias voltage is set to satisfy $0.10<X<0.40$, where $X=B/(A+B)$.

29. The image forming apparatus according to claim 21, wherein an absolute value of the first peak voltage is larger than an absolute value of the second peak voltage.

* * * * *